US007547020B1

(12) United States Patent
Kohavi

(10) Patent No.: US 7,547,020 B1
(45) Date of Patent: Jun. 16, 2009

(54) THREE DIMENSIONAL TOY HAVING MULTI-SHAPED INTERLOCKING MEMBERS WHICH HAVE A SPRING MECHANISM INSIDE A CYLINDRICAL THREADED SHAFT FOR INTERLOCKING ONE MEMBER TO ANOTHER MEMBER

(76) Inventor: Ezra Kohavi, 5227 Andasol Ave., Encino, CA (US) 91316

( * ) Notice: Subject to any disclaimer, the term of this patent is extended or adjusted under 35 U.S.C. 154(b) by 189 days.

(21) Appl. No.: 11/724,137

(22) Filed: Mar. 14, 2007

(51) Int. Cl.
*A63F 9/08* (2006.01)
*A63H 33/04* (2006.01)

(52) U.S. Cl. ..... 273/153 S; 446/119; 273/159

(58) Field of Classification Search ..... 273/153 R, 273/157 R, 153 S, 159, 156; 446/119, 490
See application file for complete search history.

(56) References Cited

U.S. PATENT DOCUMENTS

| | | | | | |
|---|---|---|---|---|---|
| 956,632 | A | * | 5/1910 | Finch | 446/119 |
| 2,115,012 | A | | 4/1938 | Douglas | |
| 2,825,178 | A | * | 3/1958 | Hawkins | 446/119 |
| 3,222,072 | A | * | 12/1965 | Dreyer | 273/157 R |
| 3,523,384 | A | | 8/1970 | Adelsohn | |
| 3,577,673 | A | * | 5/1971 | Monestier | 446/490 |
| 4,392,323 | A | * | 7/1983 | Rubik | 273/153 S |
| 4,484,406 | A | | 11/1984 | Matusmoto et al. | |
| 4,511,144 | A | | 4/1985 | Roberts | |
| D285,226 | S | | 8/1986 | Kassai | |
| 4,997,375 | A | * | 3/1991 | Heinz | 446/119 |
| 5,302,148 | A | * | 4/1994 | Heinz | 446/119 |
| 5,344,147 | A | | 9/1994 | Lee | |
| 5,992,850 | A | | 11/1999 | Li | |
| D422,036 | S | | 3/2000 | Laserna | |
| 6,129,356 | A | | 10/2000 | Li | |
| 6,241,248 | B1 | | 6/2001 | Winter | |
| 6,460,850 | B1 | | 10/2002 | Dodek, II | |
| 6,482,063 | B1 | * | 11/2002 | Frigard | 446/119 |
| D470,196 | S | | 2/2003 | Sorensen | |
| 6,655,685 | B2 | | 12/2003 | Tsai | |
| 6,679,780 | B1 | | 1/2004 | Shih | |
| 6,682,385 | B2 | | 1/2004 | Atzen et al. | |
| D490,483 | S | | 5/2004 | Auberger | |
| 2005/0133994 | A1 | | 6/2005 | Narasimhan | |

* cited by examiner

*Primary Examiner*—Steven Wong
(74) *Attorney, Agent, or Firm*—Thomas I. Rozsa

(57) ABSTRACT

The present invention is a manipulative toy formed of a collection assemblage of three dimensional shape members that can be any multiplicity of desired shapes. The embodiments of the various members can be formed in any abstract shapes. Moreover, variant embodiments of the members can have hollow or solid shapes, can have partial surfaces, and surfaces can be flat or non flat. The present invention includes a multiplicity of differently configured spring biased interconnection means by which any adjacent shape members are interconnected.

3 Claims, 21 Drawing Sheets

THREE DIMENSIONAL TOY HAVING MULTI-SHAPED INTERLOCKING MEMBERS WHICH HAVE A SPRING MECHANISM INSIDE A CYLINDRICAL THREADED SHAFT FOR INTERLOCKING ONE MEMBER TO ANOTHER MEMBER

BACKGROUND OF THE INVENTION

1. Field of the Invention

The present invention is related to the field of three dimensional interlocking puzzles toys which can be manipulated and configured into a multiplicity of different shapes and orientations.

2. Description of the Prior Art

In general, manipulative toys and interlocking building block puzzles are known in the prior art. The following 16 patents and published patent applications are the closest prior art references which are related to the present invention.

1. U.S. Pat. No. 2,115,012 issued to Harry A. Douglas on Apr. 26, 1938 for "Connecting Means" (hereafter the "Douglas Patent");

2. U.S. Pat. No. 3,523,384 issued to Louis Adelsohn on Aug. 11, 1970 for "Fastenable Three-Dimensional Puzzle Pieces" (hereafter the "Adelsohn Patent");

3. U.S. Pat. No. 4,484,406 issued to Takao Matusmoto et al. on Nov. 27, 1984 for "Connected Prism Elements Swivellingly" (hereafter the "Matsumoto Patent").

4. U.S. Pat. No. 4,511,144 issued to Patrick A. Roberts on Apr. 16, 1985 for "Multi-Cube Puzzle" (hereafter the "Roberts Patent");

5. U.S. Pat. No. Des. 285,226 issued to Kenzou Kassai on Aug. 19, 1986 for "Construction Toy" (hereafter the "Kassai Design Patent");

6. U.S. Pat. No. 5,344,147 issued to Sand-dae Lee on Sep. 6, 1994 for "Multi-Cube Puzzle" (hereafter the "Lee Patent");

7. U.S. Pat. No. 5,992,850 issued to Chen Sen Li on Nov. 30, 1999 for "Four-Layer Intellectual Cube") (hereafter the '850 Li Patent");

8. U.S. Des. Pat. No. 422,036 issued to Santiago Laserna Fernandez on Mar. 8, 2000 for "Toy Block" (hereafter the "Laserna Fernandez Design Patent");

9. U.S. Pat. No. 6,129,356 issued to Chen Sen Li on Oct. 10, 2000 for "Five-Layer Intellectual Cube" (hereafter the "356 Li Patent");

10. U.S. Pat. No. 6,241,248 issued to Stephen J. Winter on Jun. 5, 2001 for "Interlocking Solid Puzzles With Sliding Movement Control Mechanisms" (hereafter the "Winter Patent");

11. U.S. Pat. No. 6,460,850 issued to Samuel M. Dodek II on Oct. 8, 2002 for "Cube Puzzle" (hereafter the "Dodek Patent");

12. U.S. Des. Pat. No. D470,196 issued to Soren Christian Sorensen on Feb. 11, 2003 for "Toy Building Element" (hereafter the "Sorensen Design Patent");

13. U.S. Pat. No. 6,655,685 issued to Ching-Hung Tsai on Dec. 2, 2003 for "Three-Dimensional Jigsaw Puzzle" (hereafter the "Tsai Patent");

14. U.S. Pat. No. 6,679,780 issued to Sywan-Min Shih on Jan. 20, 2004 for "Polyomino Piece For Games" (hereafter the "Shih Patent");

15. U.S. Pat. No. 6,682,385 issued to Bent Atzen et al. on Jan. 27, 2004 for "Toy Building Element With Transversal Openings" (hereafter the "Atzen Patent");

16. U.S. Des. Pat. No. D490,483 issued to Benoit M. Auberger on May 25, 2004 for "CUBE" (hereafter the "Auberger Design Patent"); and 17. U.S. Published patent application No. 2005/0133994 issued to Keshavalyenger Yoga Narasimhan on Jun. 23, 2005 for "Self-Interlocking Cubic Puzzle" (hereafter the "Narasimhan Published Patent Application").

The Douglas Patent discloses the concept of having a jack with a multiplicity of intersecting bores as illustrated in FIG. 5 including having female threaded members 21 and 22 having a transverse internal screw-threads 23 and 24. There is a threaded stud 2 that is threaded directly therein. A tight engagement between the stud and the jack is shown by having a biasing means including a steel ball and the spring. This device is for a different purpose than the present invention.

The Adelsohn Patent discloses a concept of having a triad of male prong members 14 which are inserted into receiving bores 32 as best illustrated in the mating figure of FIG. 7. It differs from the present invention in that the means by which the building blocks of the invention re held together is not flexible; once a piece is assembled together with another, it cannot be rotated or put in a different position, unless jarred apart and assembled in an alternative position.

The Matsumoto Patent discloses a multiplicity of interlocking triangular members which are interlocked together by a screw thread assembly 32 so that one member can be rotated relative to the other member to create an infinite number of shapes as illustrated in FIGS. 5, 6, and 7. However, the device operates by rotation on a threaded swivel joint.

The Roberts Patent discloses a multi-cube puzzle with means to obtain the individual cubes 14 in an assembled relation for ease of manipulation. There is included end retaining members or caps 20 and 22 disposed at the distal end of each leg 18 of the core 12. Each retaining member possess a flange-like exterior periphery slightly larger than a single face of smaller cube 14. Each of the smaller cubes 14 is free to slide laterally or vertically into the single hole or void cube space provided in the cubical array.

The Kassai Patent is a design which discloses a construction toy having a multiplicity of male threaded members which can be threaded into female receiving members.

The Lee Patent discloses a multi-cube puzzle wherein there are female members and male members so that one can be inserted into the other to create a different design. The pieces contain color elements to facilitate creation of a color pattern design. Each body element 2 of the body assembly 100 is made of transparent plastic and has a cubic structure, the top of which is hollow with flanges with rounded corners as shown in FIG. 5. The body element 2 has a screw hole 22 in the center of the bottom part 24A to fix the body element 2 to the central core 50. The bottom part 24A of the body element has four legs 25 along the side of the bottom, each of which is half the dimension of one side, to be cross-combined with the corresponding leg of another body element positioned at a right angle to the first body element.

The '850 Li Patent discloses a four-layer intellectual cube with the operating mechanism best illustrated in FIGS. 9 and 10. The axle block 10 is assembled with the rotatable blocks 20. Each of the square limiting plates 22 of the rotatable blocks 20 is drilled to form a through hole 23 on the tailing end of its corresponding pivot joint 21, and a sleeve 24 with a flange on the outer end thereof is inserted in the through-hole 23, aligning the inner end of the sleeve 24 with a corresponding pin hole 11. A screw 25 is threaded in the sleeve 24 and is fixedly screwed in the in hole 11, so that the rotatable block 20 is confined on the hole 11 but is rotatable about it.

The Laserna-Fernandez Design Patent discloses male and female interlocking members wherein the male is inserted into a group therein within the female so that the blocks can form any multiplicity of designs.

The '356 Li Patent is a five layer intellectual cube. Referring to assembled structure of the first blocks 10 and the central axle block 100 a shown in FIGS. 4 to 6, the first blocks 10 are hollow and are generally "T" shaped. The tops thereof face outwardly and form rotatable plates 11, and a rotation axle 12 is provided on the bottom of each of them. The bottom surfaces of the rotatable plates 11 are all arciform, and the rotation axles 12 can be pivotally inserted into the six axle rods 101 of the central axle block. The device operates differently from the present invention.

The Winter Patent discloses an interlocking cube puzzle with sliding movement control mechanism. The concept here is to have a multiplicity of interlocking channels with male and female interlocking members. Specifically referring to FIGS. 1, 2 and 3 there are different various channels carved into the sides of the cuboid with male interlocking members to interlock female members so that the puzzle can be created in any shape.

The Dodek Patent discloses a cube puzzle wherein the members are interlocked by having an opening extending through the puzzle through which a threaded member can be extended and fastened in place by a wingnut. The blocks can be assembled together in only a single predetermined manner.

The Sorensen Patent is a design patent which discloses male and female slotted members in a block for the toy building block.

The Tsai Patent is a three-dimensional jigsaw puzzle. It consists of a multiplicity of male prong members inserted into a multiplicity of female members with various orientations as illustrated in FIGS. 1 and 2 to create a multiplicity of different shapes. The design can also be varied so that the overall shape of the figure can be varied as shown in FIG. 8.

The Shih Patent discloses polyomino pieces which basically interact having a male and female member to enable any type of design to be created as illustrated in FIGS. 4, 5, and 6. Specifically, the male members 18 can be inserted into the rectangular openings 1 as illustrated in FIG. 7. There are also various shapes for male members including round a shown in FIG. 7, polyomino as shown in FIG. 8, crosses as shown FIG. 10, etc.

The Atzen Patent is a toy building element with transversal openings. There are a multiplicity of male and female interlocking members and circular openings 7 to receive a male member in a snap fit to create a structure.

The Auberger Design Patent discloses a cube with male and female members on its sidewalls so that the cubes can be interlocked.

The Narasimhan Published Patent Application discloses a self-interlocking cube. It is a spatial logical toy composed of twenty-four identical elements plus eight identical tetrahedral solid elements and a central solid core member arranged in a self-interlocking manner to form a cube. External triangular surfaces of eight toy elements form one face of the overall large cube, and each toy element can be rotated in any direction of the spatial axis within the cube. By rotating the toy elements, several combinations become possible.

There is a significant need for an improved three dimensional puzzle with improved interlocking features which enable a large multiplicity of different puzzle orientation to be formed.

SUMMARY OF THE INVENTION

The present invention is a manipulative puzzle or toy formed of an assemblage of three dimensional abstract shapes. The embodiments of each member can be formed from any abstract shape which can have any kind of surfaces. Moreover, variant embodiments of the members can be hollow or solid (with at least one interior chamber), having at least one surface which has an opening or having an entirely closed surface, and can be made from any type of material. The present invention includes a multiplicity of differently configured spring biased interconnection means by which any adjacent member or members can be interconnected to one or more adjacent member or members. This means that one member can "branch" into many members and also many adjacent members can "converge" into one adjacent member. This relationship of connectivity betweens the member is called "many to many" and it creates a kind of convoluted arrangement of all of the members in the three dimensional space. All of those arrangements of the members can also be considered as an "open ended" toy, meaning that the user can always add more shape members to any part of the toy.

The central innovation of the present invention is the flexible interlocking mechanism that keeps any adjacent members together while allowing the interconnected members a certain degree of freedom for sliding and rotational movement relative to each other. By manipulation of one member, or some of the members or all of the members having different shapes belonging to an assemblage toy, many multiplicities of final stable shapes can be created. In addition, if more than one assemblage toy is used, they can be entangled together without any interconnection means to create more sophisticated and complex final stable shapes.

There are two interconnecting mechanisms of the present invention. The first interconnecting mechanism comprises a bolt-spring-cup mechanism in which the spring is sleeved onto a bolt, the bolt head or any stopped means acts as a stopper that prevents the spring from getting out from that side, and from the other side there is a cup with a hole in its center that is free to move on the bolt and that is sleeved on the bolt after the spring is sleeved on, and prevents the spring from getting out on that side. The bolt acts like a core for the spring and the spring is trapped between the bolt head or any stopper means and the moving cup. Another small variant on this mechanism is that the position of the spring can be relocated to be attached from one end to the bolt head or any stopper means and from the other end to the bottom of the member's cavity where the mechanism is to reside, and this variation eliminates the cup. Consequently, the function of the spring is changed from being a compressed spring at the time that the member is in movement to being a stretched spring at the time of the movement.

The following definitions apply in this application: Starting shape members are members that are not presently connected to other members but can be interconnected to other members. Ending shape members are members that can have other members interconnected to them but they do not interconnect to any other members.

With the use of the present invention mechanism each shape member (besides starting shape members) will have at least one small hole, a receiving hole on its surface to permanently receive the end of the bolt from the interconnection mechanism of the adjacent members. The end of the bolt from the adjacent member will screw in or be pushed in and for either also glued into that hole, or any other attaching means so that the attachment is permanent, and will ensure that each shape member will be permanently connected by interconnection means to each other.

In addition, each shape member (beside end shape members) of the present invention mechanism has at least one opening on its surface, called "outgoing opening" with a small locally flat area on it. This "outgoing opening" gives the freedom to the interconnection mechanism that resides inside the member cavity to move from one position to another relative to its adjacent member. The "outgoing openings" can be made of multiple sets of openings on each surface where one set of openings is defined as one mesh of many slots (not necessarily straight) on the surfaces that connect together like tunnels and they all terminate by one cavity (in case of non-hollow shapes). The end of the bolt of the interconnection mechanisms will stick out from those slot holes to be connected to the adjacent member. There can be more than one cavity in each shape member (beside "end shape members") and therefore there can be more than one set of mesh slots (hollow shape can have different mesh slots as well, without the need for a cavity). Also, there can be more than one interconnection mechanism residing in each shape member. There can be multiple interconnections in each mesh/cavity of slots and multiple interconnections in multiple meshes. In summary, the multi mesh slots with multi cavities and with multi interconnection mechanisms will enable a member to interconnect to multiple members. There are some correlation requirements between the width of the slots and the diameter of the cup, so the cup will not be able to get out of the opening slots. Each member shape will have at least one interconnection mechanism reside inside his cavity beside each "end shape members". The user of the toy will use a pulling force on one of the members, overcoming the spring biasing force and enabling that member and the bolt to moved together to a new position where the bolt will rest in one of many positions, called "rest point", on the "outgoing opening" on the face of an adjacent member. After the user releases the member, the biasing spring retains the two adjacent members in the new fixed position.

The second interconnection mechanism that gives maximum flexibility on movement of adjacent members and also symmetrical movement between two adjacent members that are interconnected comprises a bolt with a head or a stopper plate or other stopper means in one of its end, a spring sleeved on the bolt blocked by the stopper means, a cup with an opening toward the spring sleeved after, another cup with opening facing to other direction sleeved on a second spring sleeved after and another stopper plate, or a lock nut, or other stopper means closing the other side of the bolt. The bolt with the first spring and the first cup is inserted into the first shape member cavity so that the bolt extend through the opening slots of the shape member to enter to the second shape member through its opening slots, into it cavity and than a second cup sleeved on, and the second spring sleeved after and closed by the second stopper plate or the lock nut in a permanent manner.

That interconnecting mechanism gives the ability to both adjacent members to move independently of each other and with that creates more possibilities of relative movement between each other. The interconnection mechanism is like taking the first interconnection mechanism and doubling it by a mirror image. This mechanism creates symmetry between "incoming openings" and "outgoing openings" so that they become the same. There is no need for any permanent attachment means to the other member shape any more and also there is no need for a hole for the incoming receiving interconnecting mechanism. All the sets of meshes on a member serve with the same purpose. Any combination of the interconnection mechanisms described above can be used on the same toy. Without limiting this invention, it is mentioned we need to mention that is order to create stable final shapes, some more restrains can be added:

1. Any adjacent members have to touch each other at the interconnection rest point. Otherwise, if the shape members do not touch each other, there will be no friction between the members and the bolt of the interconnecting mechanism will be exposed in the air and the members will freely swing and rotate around the bolt. In order to increase stability and achieve a "locking mechanism" that will avoid the rotation between members, it is required that the shape members themselves be designed to touch at the rest touching point of the adjacent members, without any obstacles (as an example of parts that are designed not to touch is two opposite crests that can not touch each other in the center). The other requirement is on the bolt size and the size of cavities, so where member's parts are attached, there will be sufficient room to retain the bolt inside the cavities of the members.

2. The "locking mechanism" can be imposed to avoid rotation or sliding between two adjacent members once they have been interconnected at a rest point and thus create very stable shapes. Around each of the holes on the surface a bolt is permanently attached into the "incoming opening" and around the designed rest point on the "the outgoing opening" meshes where the bolt can move from one position to another and the adjacent member can rest, as in interconnection mechanism #1, or around the designed rest point where there are any opening meshes in interconnection mechanism #2, there can be added either a male or female "locking mechanism". Once members are touching each other at the design rest point, the mating of the female from one adjacent member and male from another adjacent member take place. On any given member there can be mixes of female or male "locking mechanisms".

3. An additional benefit of the "locking mechanism" is that it gives some degree of freedom to orient one member relative to another, meaning that it limits the number of rotational positions that one member can interconnect with another member on the same rest point. For example, if the locking mechanism is made up of a recess of an equal side triangle on the surface of the member shape, then the members that will be interconnected and mate on to this surface will have three rotational possibilities of orientation relative to each other.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purposes of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is a unique three dimensional puzzle or toy which is configured from a multiplicity of members of abstract shapes wherein each can be any desired shape and wherein adjacent shape members are interconnected by alternative unique interconnecting means which enable one shape member to be rotated or shift relative to an adjacent shape member. By manipulation of the members with all the possible relative positions and movements one can create an infinite variety of possible final shapes.

Figure 1:
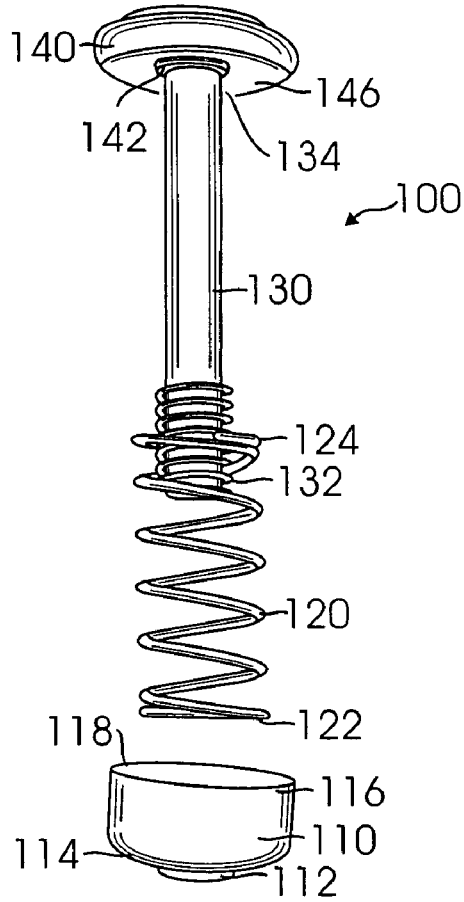
FIG. 1 is an exploded perspective view of one preferred embodiment of an interconnecting means of the present invention.
Figure 2:
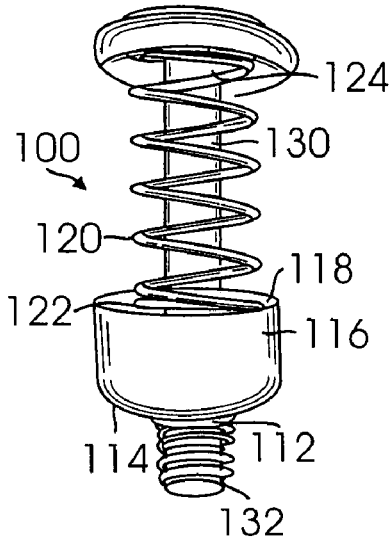
FIG. 2 is an assembled perspective view of the interconnecting means illustrated in FIG. 1.

The key innovative feature of the present invention is the creation of unique spring biased interconnecting means by which at least two adjacent shape members can be movably retained together. Referring to FIG. 1 and FIG. 2, one preferred embodiments of an interconnecting means is illustrated. FIG. 1 is an exploded view to show the component parts and FIG. 2 is an assembled view with the parts placed together.

A first interconnecting means 100 comprises a retaining cup 110 which has a bottom opening 112 which is preferably centrally disposed on the bottom wall 114 of the retaining cup 110. The bottom wall 114 extends into a circumferential sidewall 116 and the bottom wall 114 and circumferential sidewall 116 surround an interior chamber 118 of the retaining cup 110. A biasing spring 120 has a first end 112 and a second end 124. The first end 122 is press-fitting into the retaining cup 110 and is retained within interior chamber 118 and presses against bottom wall 114 and is surrounded by circumferential sidewall 116. A bolt 130 is threaded and glued or pushed and glued into a spacer stop plate 140 having interior opening 142 to receive a second end 134 of bolt 130. The biasing spring 120 surrounds bolt 130 and is compressed between the interior face 146 of spacer stop plate 140 and retaining cup 110. A first end 132 of the threaded bolt 130 extends through opening 112 in the bottom wall 114 of retaining cup 110 and extends so that it can be threaded and glued or pushed and glued into a receive hole of another shape member. The assembly of the stop plate 140, portion of the bolt 130, biasing spring 120 and retaining cup 110 are retained within a chamber of a shape member. The biasing spring permits 120 the distance that the threaded bolt extends out of the retaining cup 110 and therefore out of a shape member to vary so that as the spring is compressed, the amount of extending bolt is increased so that one shape member can be moved relative to a adjacent the shape member as will be described later on. Instead of being a separate stop plate 140, the member 140 can instead be an integrated head of the bolt attached at the end 134 of the bolt so that the interior surface 146 is the interior surface of the bolt head 140 and the second end 124 of biasing spring 120 is pressed against the interior surface of the bolt head. For convenience the bolt 130 can be fully threaded, but it is not a necessity and as illustrated in FIGS. 1 and 2, only the one adjacent second end 124 is threaded.

Figure 3:
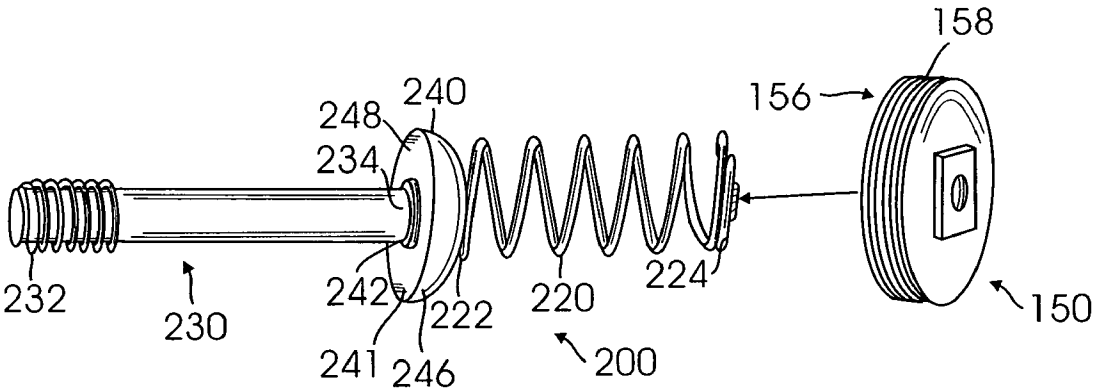
FIG. 3 is an assembled perspective view of an alternative embodiment of an interconnecting means of the present invention.

An alternative embodiment of spring biased interconnecting means 200 is illustrated in FIG. 3. The bolt 230 is threaded and glued or pushed and glued into spacer stop plate 240 threaded hole, or just a hole 242. Instead of a spacer stop plate, the member 240 can be the head of the bolt 230 and the head is attached to the bolt at end 234. The biasing spring 220 is affixed to the upper surface 246 of spacer stop plate 240 so that the bottom 222 of biasing spring 220 rests against the top surface 248 of the spacer stop plate 240 (or head of the bolt) and the top 224 of the biasing spring 220 is pressed against the lower interior surface of a shape member as will be described later on (in case of shape member of FIG. 6, it will pressed against the sealing member retaining plate 150). The first end 232 of bolt 230 will extend out of an opening in a shape member. The assembly of the biasing spring 220, spacer stop plate 240 (or head of the bolt) and portion of the bolt 230 is retained within a chamber of a shape member so that a portion of the bolt 230 adjacent first end 232 extends out of a shape member and the rounded cup shaped surface 246 of spacer stop plate 240 prevents the assembly from entirely being pulled or pushed out of the interior chamber of the shape member. The biasing spring permits 220 the distance that the bolt extends out of the shape member to vary so that as the spring is expanded, the amount of extending bolt is increased so that one shape member can be moved relative to an adjacent the shape member as will be described later on and thereafter returned by the compression force of the spring.

Figure 4:
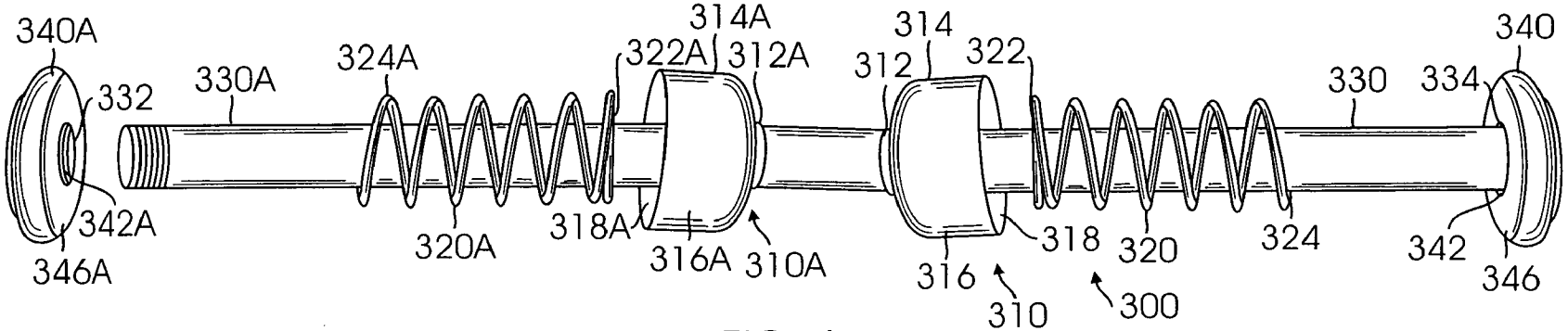
FIG. 4 is an exploded perspective view of a third embodiment of an interconnecting means of the present invention.
Figure 5:
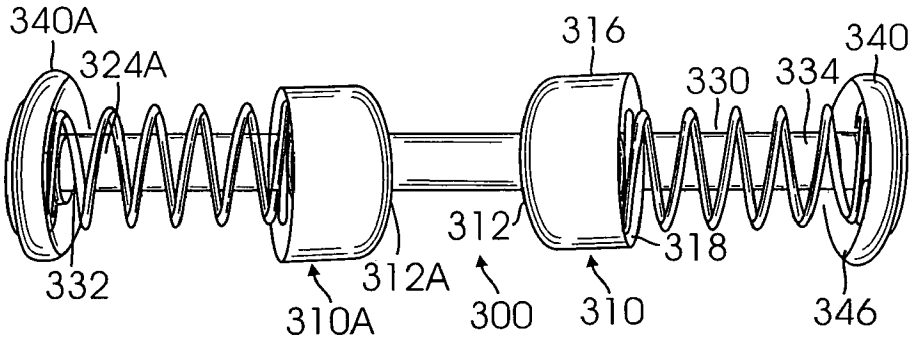
FIG. 5 is an assembled perspective view of the interconnecting means illustrated in FIG. 4.

The third variation for the interconnecting means 300 is illustrated in the exploded view of FIG. 4 and the assembled perspective view of FIG. 5. The third variation is a double interconnecting means taken from the first variation of FIG. 1. A third interconnecting means 300 comprises a pair of oppositely oriented retaining cups, namely first retaining cup 310 and which has a bottom opening 312 which is preferably centrally disposed on the bottom wall 314 of the retaining cup 310. The bottom wall 314 extends into a circumferential sidewall 316 and the bottom wall 314 and circumferential sidewall 316 surround an interior chamber 318 of the retaining cup 310. The second retaining cup 310A is a mirror image of the first retaining cup 310. The second retaining cup 310A has a bottom opening 312A which is preferably centrally disposed on the bottom wall 314A of the retaining cup 310A. The bottom wall 314A extends into a circumferential sidewall 316A and the bottom wall 314A and circumferential sidewall 316A surround an interior chamber 318A of the retaining cup 310A.

A first biasing spring 320 has an inner end 322 and an outer end 324. The inner end 322 is press-fitted into the first retaining cup 310 and is retained within interior chamber 318 and presses against bottom wall 314 and is surrounded by circumferential sidewall 316. A bolt 330 is threaded and glued or pushed and glued into a first spacer stop plate 340 having interior hole threads 342 to receive a first outer end 334 of threaded bolt 330. Alternatively, the member 340 can be the head of the bolt 330 and is attached at end 334. The first biasing spring 320 surrounds a portion of bolt 330 and is compressed between the interior face 346 of first spacer stop plate 340 (or bolt head or any other stopper means) and first retaining cup 310. For first biasing spring 320, its outer end 324 is adjacent the interior surface 346 of first spacer stop plate 340 (or bolt head or any other stopper means) and its inner end 322 rests within interior chamber 318 of first retaining cup 310.

A second outer end 322 of the bolt 330 extends through opening 312 in the bottom wall 314 of first retaining cup 310 and extends so that it passes through opening 312A in second retaining cup 310A and is threaded and glued or pushed and glued into threads 342A of second spacer stop pate 340A (or alternatively attached to the bolt head or any other stopper means 340A). A second biasing spring 320A surrounds another portion of bolt 330 and is compressed between the interior face 346A of second spacer stop plate 340A (or bolt head or any other stopper means) and second retaining cup 310A. For second biasing spring 320A, its outer end 324A is adjacent the interior surface 346A of second spacer stop plate 340A and its inner end 322A rests within interior chamber 318A of second retaining cup 310A.

The assembly of first spacer stop plate 340 (or bolt head or any other stopper means), first biasing spring 320, first retaining cup 310 and a potion of bolt 330 rests within an interior chamber of one shape member. The assembly of second spacer stop plate 340A (or bolt head or any other stopper means), second biasing spring 320A, second retaining cup 310A and a portion of bolt 330 rests within an interior chamber of an adjacent shape member. The two shape members are interconnected by a portion of the bolt 330 between first retaining cup 310 and second retaining cup 310A. The interconnection assembly between two adjacent shape members will be described later on.

Any one of the present invention interconnection means 100, 220 or 300 can be used with any type of shape member assembly and it will be appreciated that the interconnection means can be incorporated into any desired shape member assembly. While customarily one type of interconnection means 110 200 or 300 is used with a complete puzzle toy comprised of many shape members, it is within the spirit and scope of the present invention to have more than one variation of the interconnection means incorporated into a toy assembly.

Figure 6:
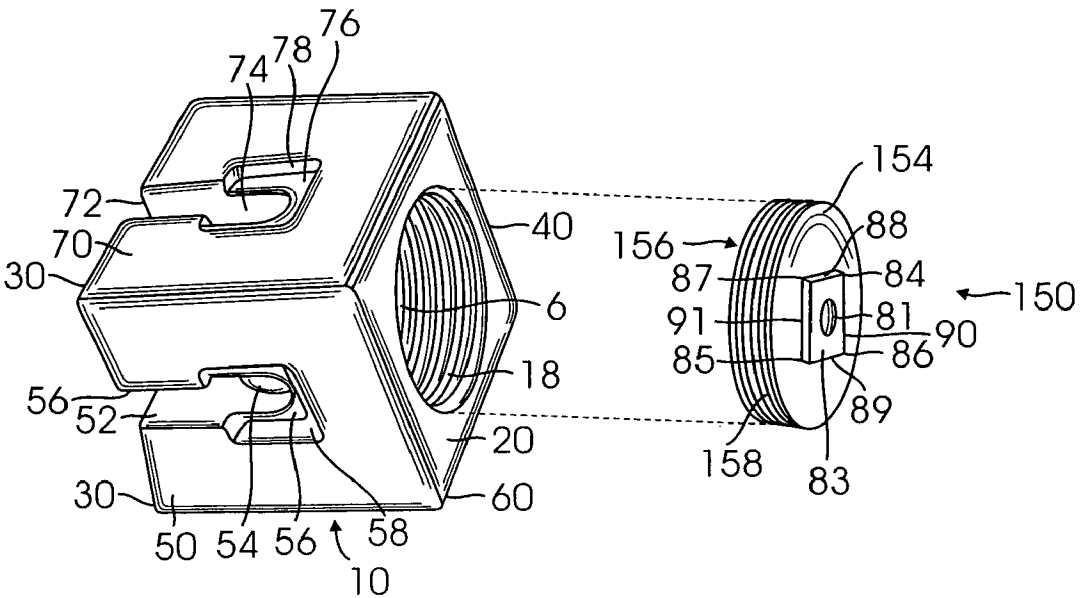
FIG. 6 is an exploded side-perspective view of a preferred embodiment of one possible shape member which is a cube of the present invention.
Figure 7:
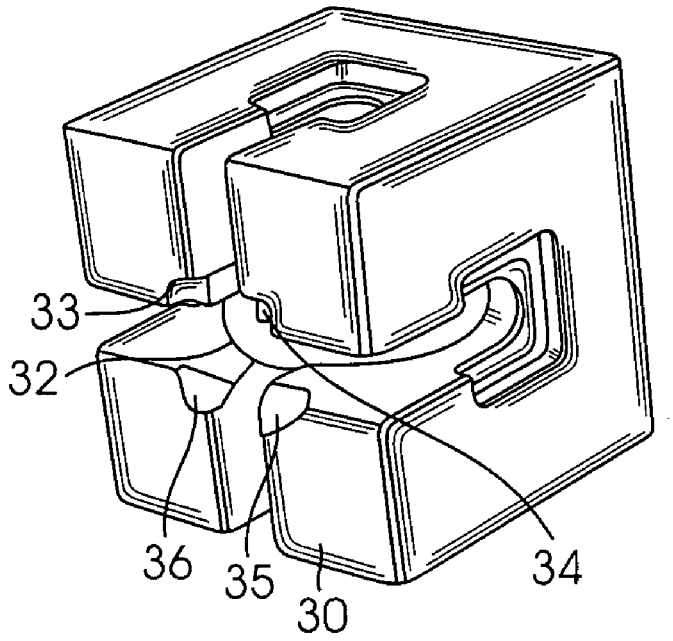
FIG. 7 is a bottom perspective view of the shape member illustrated in FIG. 6.
Figure 8:
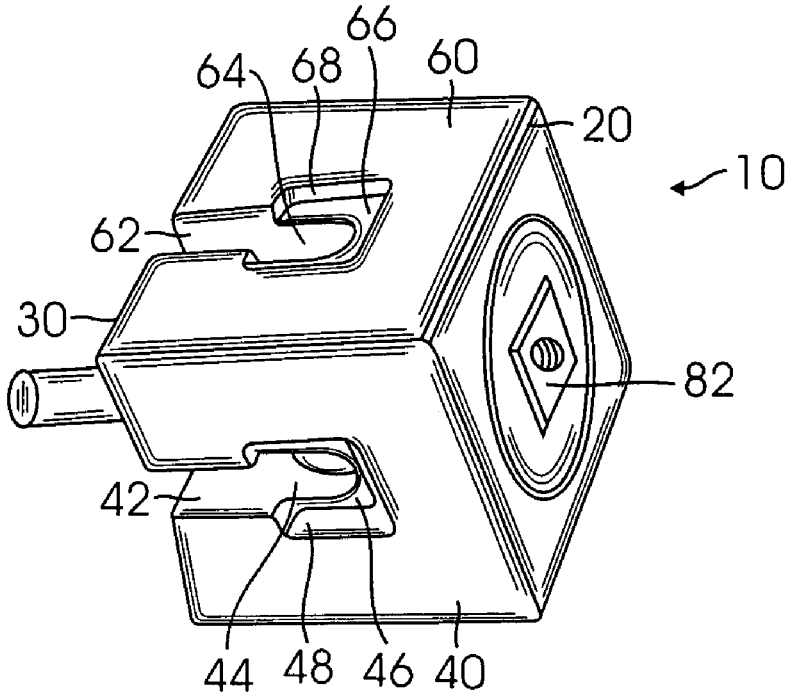
FIG. 8 is a top perspective view of the shape member, assembled with an interconnecting mechanism inside as illustrated in FIG. 6.

Referring to FIG. 6, there is illustrated an exploded side perspective view of an embodiment of a square shape 10. FIG. 7 is a bottom perspective view of and embodiment of a shape member 10. FIG. 8 is a top perspective view of the shape member 10 with the sealing member in place and with the interconnection mechanism inside. Referring to FIGS. 6 through 8, shape member 10 includes a top face 20, a bottom face 30, a first sidewall 40, a parallel oppositely disposed sidewall 50, and a third sidewall 60 and a parallel oppositely disposed fourth sidewall 70. In this preferred embodiment 10, the four sidewalls 40, 50, 60 and 70 are identical. Referring to FIG. 8, first sidewall 40 has an interior slot 42 extending from bottom face 30 upwardly and terminating in recess 44 having a recessed face 46 and surrounded by a recess wall 48. The recessed face 46 and recess wall 48 form a rest point on first sidewall 40. Referring to FIG. 6, second sidewall 50 similarly has an interior slot 52 extending from bottom face 30 upwardly and terminating in recess 54 having a recessed face 56 and surrounded by a recess wall 58. The recessed face 56 and recess wall 58 form a rest point on second sidewall 50. In this embodiment of shape member 10, interior slots 42 and 52 are parallel and recessed faces 46 and 56 and recessed walls 48 and 58 are parallel.

Referring again to FIG. 8, second sidewall 60 has an interior slot 62 extending from bottom face 30 upwardly and terminating in recess 64 having a recessed face 66 and surrounded by a recess wall 68. The recessed face 66 and recess wall 68 form a rest point on third sidewall 60. Referring to FIG. 6, fourth sidewall 70 similarly has an interior slot 72 extending from bottom face 30 upwardly and terminating in recess 74 having a recessed face 76 and surrounded by a recess wall 78. The recessed face 76 and recess wall 78 form a rest point on fourth sidewall 70. In this embodiment of shape member 10, interior slots 62 and 72 are parallel and recessed faces 66 and 76 and recessed walls 68 and 78 are parallel.

Referring to FIG. 6, shape member 10 has an interior chamber 6 which terminates in a threaded opening 18 at upper face 20. A retaining plate 150 has exterior threads 158 by which it is threaded into receiving threads 18 to close the upper surface of shape member 10. The upper surface 154 of retaining plate 150 has a "male" cap member 82 which projects outwardly from the upper surface 154 and interior threads 81 in "male" cap member 82. The "male" cap member 82 sides are aligned with sides of face 20.

Each recessed face 46, 56, 66, and 76 and its associated recessed wall 48, 58, 68, and 78 are called rest spots.

Referring to FIG. 6-8, bottom face 30 has a central recessed cavity 32 having four rounded recessed corners 33, 34, 35, and 36. The recessed cavity is connected with all four interior slots 42, 52, 62 and 72. The recessed cavity 32 and its four rounded corners 33, 34 35 and 36 form a rest point on bottom face 30. The dimension of the "male" cap member 82 is sized to correspond with the recessed cavity 32 and is also designed to align with the sets of recessed faces and recessed walls 46, 48, 56, 58, 66, 68, 76 and 78.

Top face 20 supports the protruding generally square "male" cap member 82 which is a rest spot mating means. The parts are sized so that the rest spot mating means such as the generally square cap member 82 fits into recessed cavity 32 and the corners 84, 85, 86 and 87 of the "male" cap member 82 are respectively received in the rounded corners 33, 34, 35 and 36 of recessed cavity 32. The rest spot mating means 82 is also sized so that it can fit within the respective rest spots of the four faces so that the top 83 of the "male" cap member 82 abuts a recessed face 46, 56, 66 and 76 and the sidewall 88, 89, 90 and 81 of the cap member 82 is surrounded by a respective recessed wall 48, 58, 68 and 78.

Figure 12:
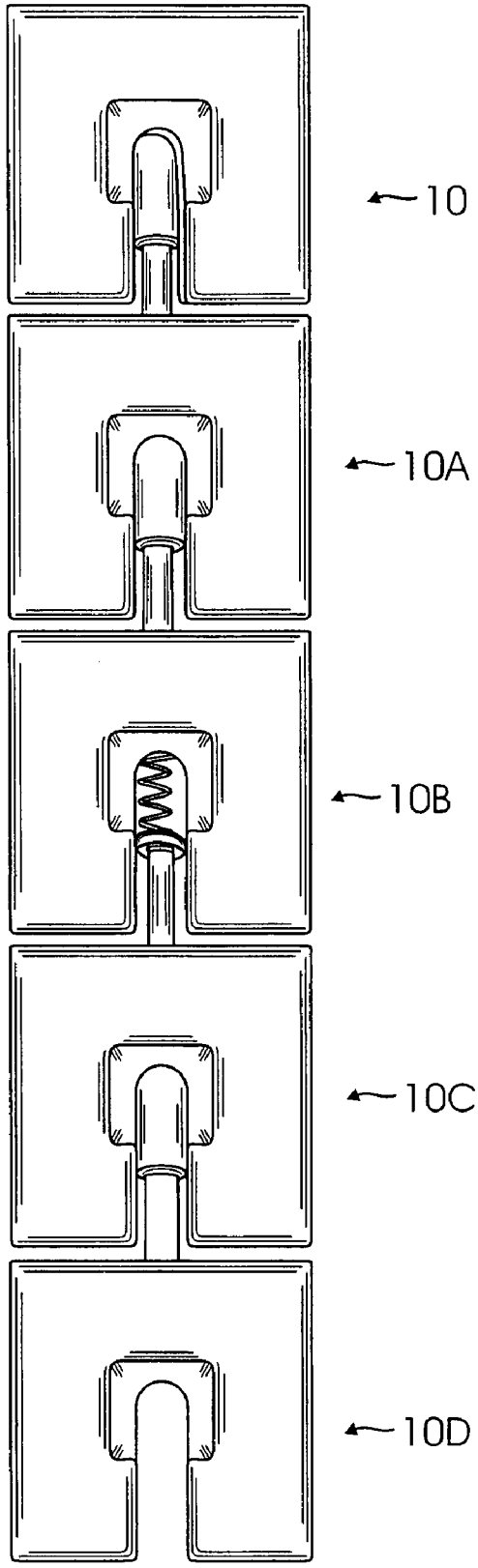
FIG. 12 is a perspective view of a multiplicity of shape members as illustrated in FIG. 6 though FIG. 8 interconnected by either the interconnecting means of FIG. 1 and/or FIG. 2, with the shape members all attached in one aligned row.

Two adjacent shape members 10 are movably retained to each other by one of the three novel interconnecting means of the present invention. By way of illustration, the first interconnecting means 100 will be described for interconnecting a multiplicity of shape members 10. As discussed, first interconnecting means 100 comprises a retaining cup 110 into which is press fitted one end of a biasing spring 120. A bolt 130 is threaded into a spacer stop plate 140 having interior threads 142 to receive one end of bolt 130 (or member 140 can be the bolt head or any stopper means attached at one end of the bolt). The "male" cap member 82 is affixed to the exterior face 154 of a retaining plate 150, and also has interior threads 83 which are aligned with the interior threads 152 of retaining plate 150. Retaining plate 150 has exterior threads 158 by which it is threaded into receiving threads 18 which are in the interior of shape member 10 and terminates at upper face 20. The biasing spring surrounds bolt 130 and is compressed between the interior face 146 of spacer stop plate 140 and retaining cup 110. The retaining cup also has an interior opening 112 through which the bolt 130 extends so that it extends out of the bottom face 30 of block shape member 10 as illustrated in FIG. 8, and is threaded into the interior threads 81 of "male" cap member 82 and interior threads 152 of retaining plate 150 and preferably are glued or otherwise affixed so that it can't be unthreaded. The shape member 10 has an interior chamber 6 which terminates in the threaded opening 18 at upper face 20 and bottom recessed opening 32 in bottom face 30. A multiplicity of shape members 10 are movably retained together as illustrated in FIG. 12. The assembly of the retaining cup 110, the biasing spring 120, a portion of the bolt 130, and retainer stop plate 140 (or bolt head or any stopper means) are retained within the interior chamber 6 so that a pulling force on one shape block member 10 which receives the end of the bolt 130 into its "male" cap member 82 and retaining plate 150 causes the biasing spring to be compressed so that the bolt 130 is slightly forced further out of the bottom opening 32 of shape 10 so that the bolt can be moved into any one of the four slotted openings 42, 52, 62 and 72 of the respective faces 40, 50, 60 and 70, so that the block shape member 10 can be oriented so that its "male" cap member 82 rests within a rest spot on a face of an adjacent shape member and retained thereon by the compression force of the biasing spring 12 after the moving force which compressed the spring is released. The retainer cup member 110 and spacer stop plate 140 (or bolt head or any other stopper means) prevents the interconnecting assembly from being entirely pulled out of the interior chamber 6 of the shape member 10. Therefore, through its unique spring biasing interconnection, one shape member can be moved to any one of five positions relative to an adjacent shape member and coming to rest at a rest spot on one of the four faces or on the rest spot on the bottom face of the shape member 10.

Figure 9:
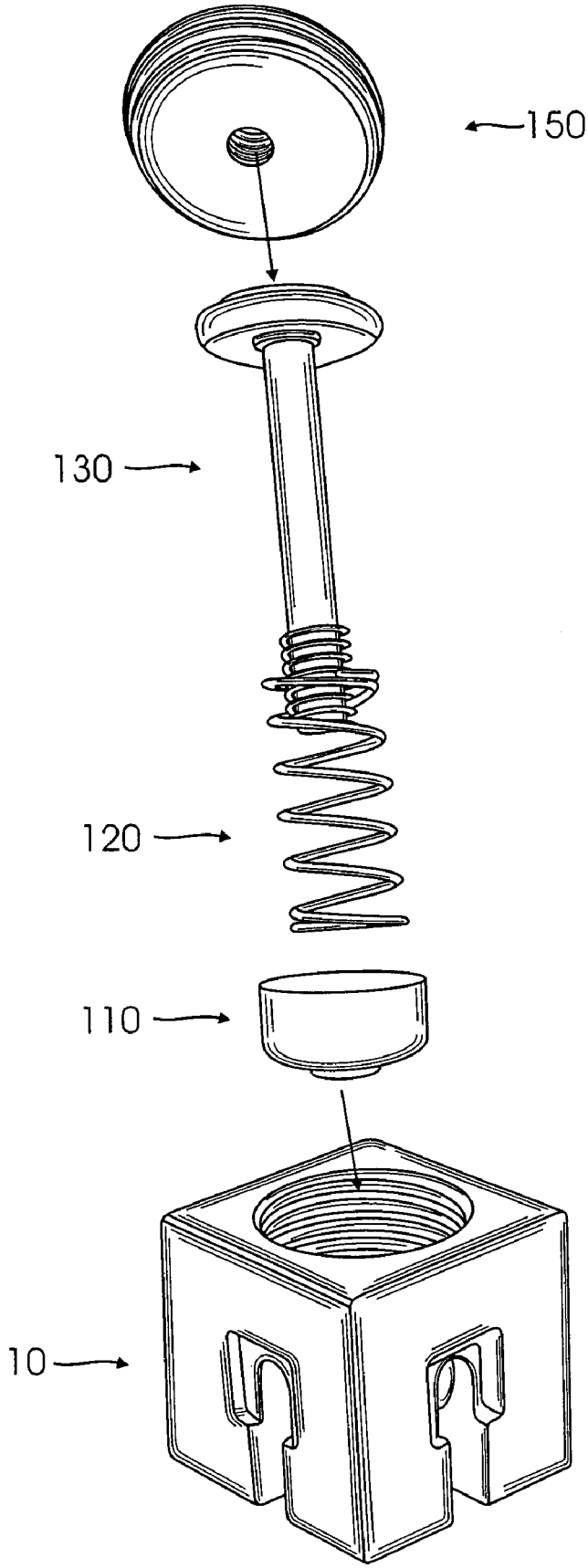
FIG. 9 is an exploded side-perspective view of one possible embodiment of the present invention of a shape member which is a cube with the interconnection mechanism in FIG. 1.

Referring to FIG. 9, there is illustrated an exploded view of how mechanism 100 is assembled in shape member 10. It comprises the bare shape member 10 with the cup 110 and with the spring 120 and with the bolt 130 with its stopper means and in the end the closing cap 150.

Figure 10:
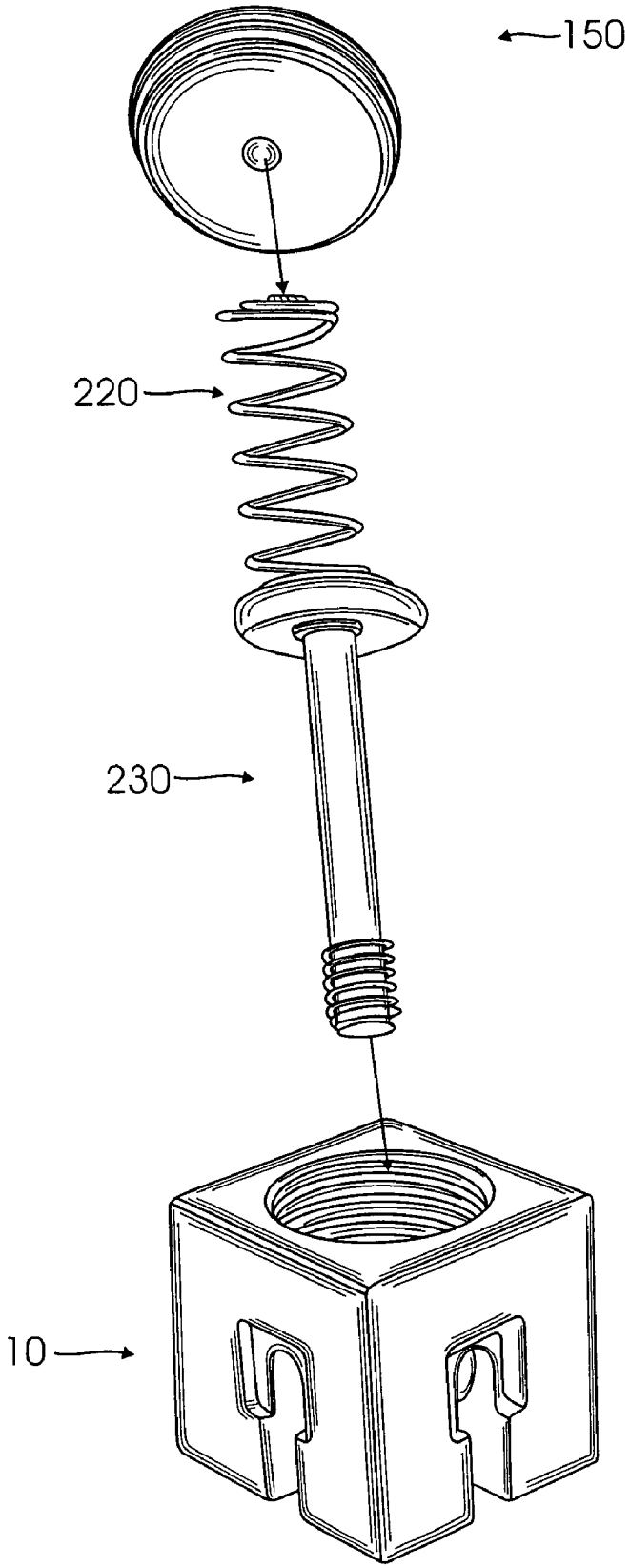
FIG. 10 is an exploded side-perspective view of one possible embodiment of the present invention of a shape member which is a cube with the interconnection mechanism in FIG. 2.

Referring to FIG. 10, there is illustrated an exploded view of how mechanism 200 is assembled in shape member 10. It comprises the bare shape member 10 with a spring 220 and with the bolt 230 with its stopper means and in the end the closing cup 150.

Figure 11:
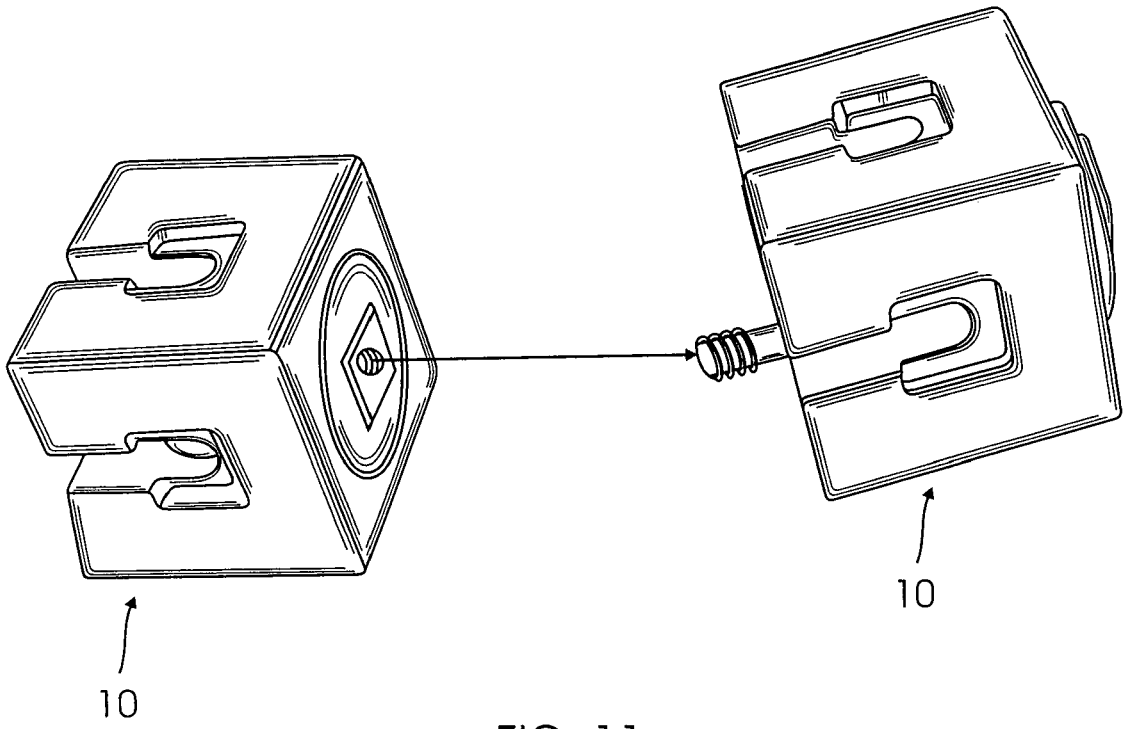
FIG. 11 is an exploded side perspective view of the two assembled shape members and the way that they going to be interconnecting.

Referring to FIG. 11, there is illustrated an exploded view of two assembled shape members 10 and the way that they are going to interconnect to each other with interconnection mechanism 100 or 200 residing inside of their respective cavities.

Figure 13:
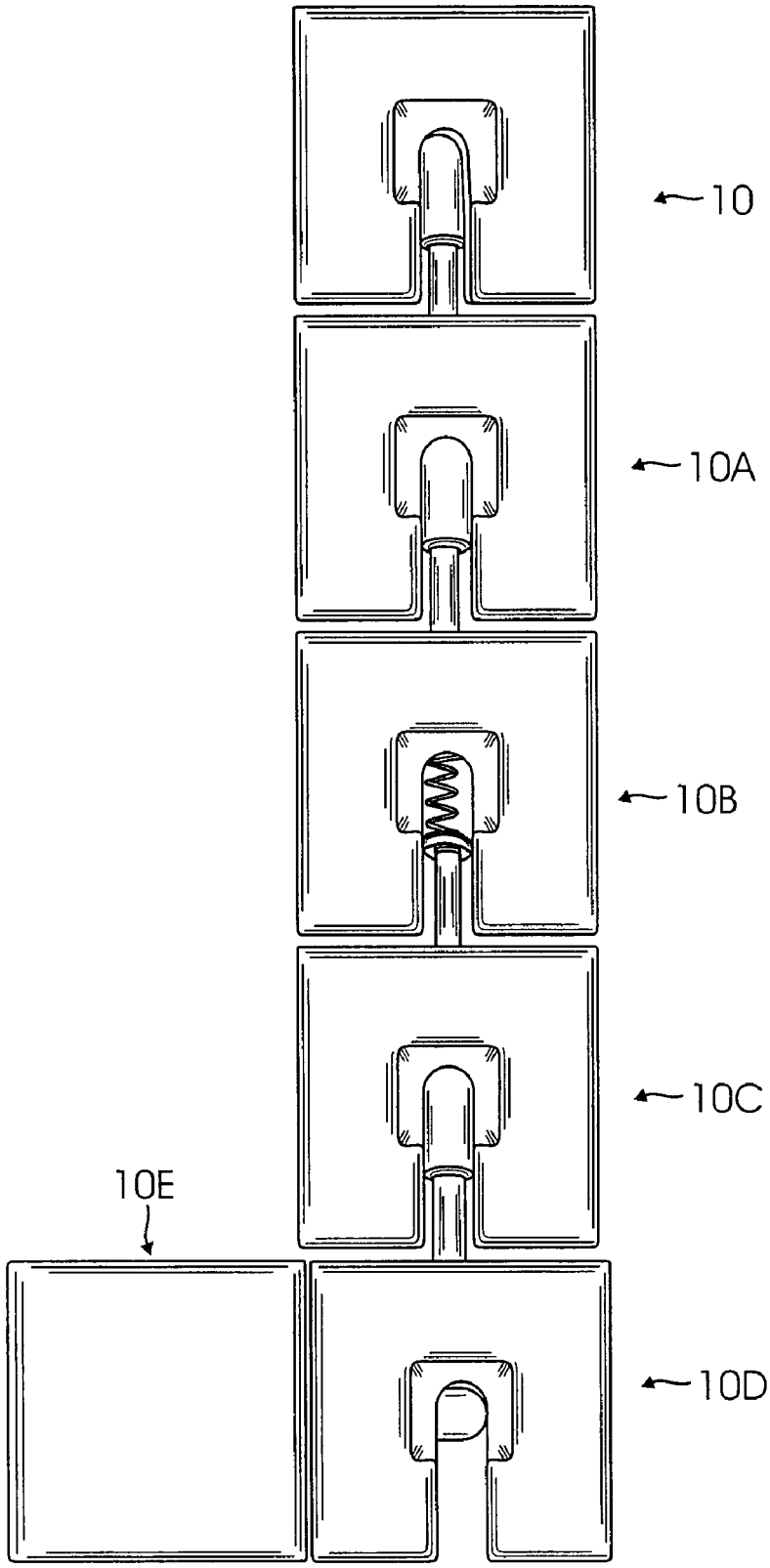
FIG. 13 is a perspective view of a mulitplicity of shape members as illustrated in FIG. 6 through FIG. 8 interconnected by either the interconnecting means of FIG. 1 and/or FIG. 2, or the interconnecting means of FIG. 3, with a shape member moved to one alternative side face of an adjacent shape member.

Referring to FIG. 12, five shape members 10, 10A, 10B, 10C and 10D are aligned in a straight row with the "male" cap member 82 of each shape member at rest within the rest spot formed by the opening 32 and four corners 33, 34, 35 and 36 of the immediately adjacent block shape member and retained in that position by the force of the compression spring. Referring to FIG. 13, there is illustrated one alternative configuration with a sixth shape member 10E moved so that its "male" cap member 82 is within a rest spot on one lateral face of the adjacent shape member 10D.

While discussed with the first interconnecting means 100, the configuration illustrated in FIGS. 12 and FIG. 13 can also be interconnected by the second interconnecting means 200. As shown in FIG. 3 and discussed, the bolt 230 is threaded into spacer stop plate 240 (or alternatively to the bolt head or any other stopper means) so that the lower surface 246 of spacer stop plate 240 faces the bolt 230. The biasing spring 220 is affixed to the upper surface 246 of spacer stop plate 240 (or bolt head or any other stopper means) and is pressed against the lower interior surface 156 of retaining plate 150 of the sealing member. The retaining plate 150 has exterior threads 158 by which it is threaded into receiving threads 18 which are in the interior of shape member 10 and terminates at upper face 20. Alternatively, the retaining plate can be integrally formed with the top face 20 of building block 10. The biasing spring 230 pushes down on the bolt so that a portion of the bolt 230 extends out of the bottom face 30 of shape member 10 and is threaded into the interior threads 81 of "male" cap member 8 and interior threads 152 of retaining plate 150 of an adjacent shape member 10 and preferably permanently affixed therein. As before, the shape member 10 has an interior chamber 6 which terminates in the threaded opening 18 at the upper face 20 and bottom recessed opening 32 in bottom face 30. The assembly of the biasing spring 220, retaining stop plate 240 (or bolt head or any other stopper means) and a portion of the bolt 230 are retained within the interior chamber 6 so that a pulling force on one cube or shape member 10 which receives the end of the bolt 230 into its "male" cap 82 and retaining plate 240 causes the biasing spring to be expanded so that the bolt 230 is slightly forced further out of the bottom opening 30 of the shape member 10 so that the bolt can be moved into any one of the four slotted openings 42, 53, 62 and 72 of the respective faces 40, 50, 60 and 70, so that the shape member 10 can be oriented so that its "male" cap member 820 rests within a rest spot on a face of an adjacent shape member and retained thereon by the pulling force of the biasing spring 230 after the moving force which expanded the spring is released. The retainer stop member 240 (or bolt head or any other stopper means) prevents the interconnecting interconnecting assembly from being entirely pulled out of the interior chamber 6 of the shape member 10. As with the previous interconnecting means, through this unique biasing interconnection, one shape member can be moved to any one of five positions relative to an adjacent shape member and come to rest at a rest spot on one of the four faces or on the rest spot on the bottom face of the shape member.

While the interconnection of a multiplicity of shape members 10 can be respectively interconnected by using interconnecting means 100 or interconnecting means 200, it is also possible to use a combination so that interconnecting means 100 can be used with some of the shape members such as 10A, 10C and 10E and interconnecting means 200 can be used with other shape members 10B.

FIG. 13 also shows the "start shape member" 10 does not need to have entrance holes and that "end shape member" 10E does not need to have any interconnecting mechanism 100 or 200 residing inside and does not need any outgoing opening slots, when it implemented with mechanism 100 or 200, and 10D.

Figure 14:
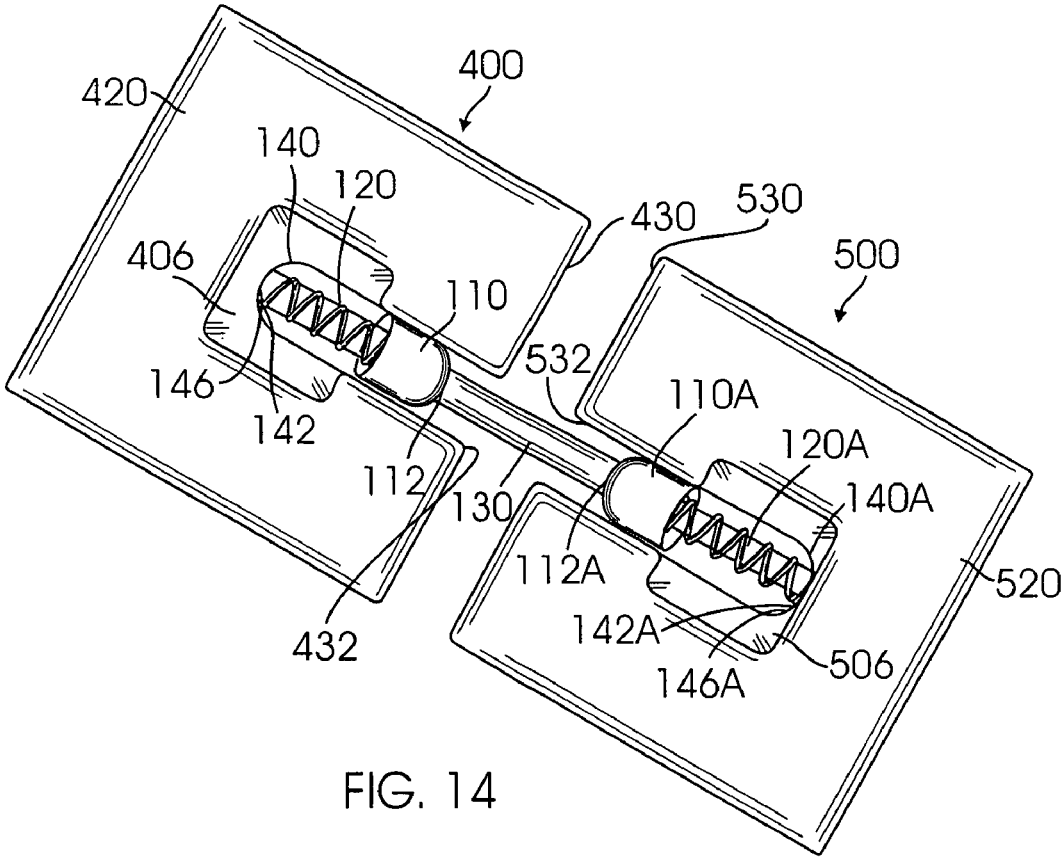
FIG. 14 is a perspective view of two shape members interconnected by the third variation of the interconnecting means illustrated in FIG. 4 and FIG. 5.

The third alternative embodiment for the interconnecting means 300 is shown in use in FIG. 14. The interconnecting means 300 comprises two oppositely disposed adjoining interconnecting means as previously discussed and illustrated in FIGS. 4 and 5. Referring to FIG. 14, shape member 400 has an interconnecting assembly comprising a retaining cup 110 into which is press fitted one end of a biasing spring 120. A bolt 130 is threaded into a spacer stop plate 140 having interior threads 142 to receive one end of bolt 130 (or alternatively member 140 is the head of the bolt to which one end is attached). The biasing spring 120 surrounds bolt 130 and is compressed between the interior face 146 of spacer stop plate 140 (or bolt head or any stopper means) and retaining cup 110. The retaining cup also has an interior opening 112 through which the bolt 130 extends so that it extends out of the bottom face 430 of shape member 400 as illustrated in FIG. 13. Adjoining shape member 500 has the identical interconnecting means but rotated 180 degrees and also includes the bolt 130 which is threaded into a spacer stop plate 140A having interior threads 142A to receive one end of bolt 130 (or alternatively a bolt head or any stopper means to which the end of the bolt is attached). The biasing spring 120A surrounds bolt 130 and is compressed between the interior face 146A of spacer stop plate 140A (or bolt head or any other stopper means) and retaining cup 110A. The retaining cup 110A also has an interior opening 112A through which the bolt 130 extends so that it extends out of the bottom face 530 of shape member 500 as illustrated in FIG. 14. The key difference in this interconnecting means 300 is that the bolt 130 is the same bolt for the interconnecting means in each shape member 400 and 500. Each shape member 400 and 500 has a respective interior chamber 406 and 506 which terminates in a bottom opening 432 in bottom face 430 and 532 in bottom face 530. The assembly of the retaining cup 110, the biasing spring 120, a portion of the bolt 130, and retaining stop plate 140 (or bolt head or any other stopper means) are retained within the interior chamber 406 and the oppositely oriented assembly of retaining cup 110A, the biasing spring 120A, a portion of the bolt 130, and retainer stop plate 140A (or bolt head or any stopper means) are retained within the interior chamber 506 with the common bolt 130 extending out bottom openings 432 and 532 and being biased by the two springs 120 and 120A so that a pulling force (or forces) on either one of the shape members 400 or 500 which receives the end of the bolt 130 causes at least one the biasing spring 120 or 120A or both biasing springs 120 and 120A to be compressed so that the bolt 130 is slightly force further out of the bottom opening 432 or 532 of shape member 400 or 500 so that the bolt can be moved into any one of the four slotted openings 42, 52, 62 and 72 of the respective faces 40, 50, 60 and 70, so that the shape member 400 can be oriented at a different orientation to shape member 500 and thereafter retained in that orientation by the compression forces of the biasing springs 120 and 120A after the moving forced which compressed the spring is released. Each retainer cup member 110 and 110A and spacer stop plate 140 and 140A (or bolt head or any other stopper means) prevents the interconnecting assembly from being entirely pulled out of the interior chamber 406 of the shape member 400 and interior chamber 506 of the shape member 500. Therefore, through its unique spring biasing interconnection, one shape member can be moved to any one of five positions relative to an adjacent shape member and come to rest at a rest spot on one of the four faces or on the rest spot on the bottom face of the adjacent shape member. The opposite top face 420 and 520 of each building bock member can have other interconnecting means such as the "male" cap 82 and can have different shapes to mix and match to receive a bolt from either of the interconnecting means 100 or 200.

In addition to the generally cube shaped shape member having faces with identical slots and recessed rest spots as illustrated in FIGS. 1 through 14, it is within the spirit and scope of the present invention to have numerous other shaped shape members utilized with the three alternative interconnecting means to form a three dimensional puzzle having an infinite number of shapes and orientations.

Figure 15:
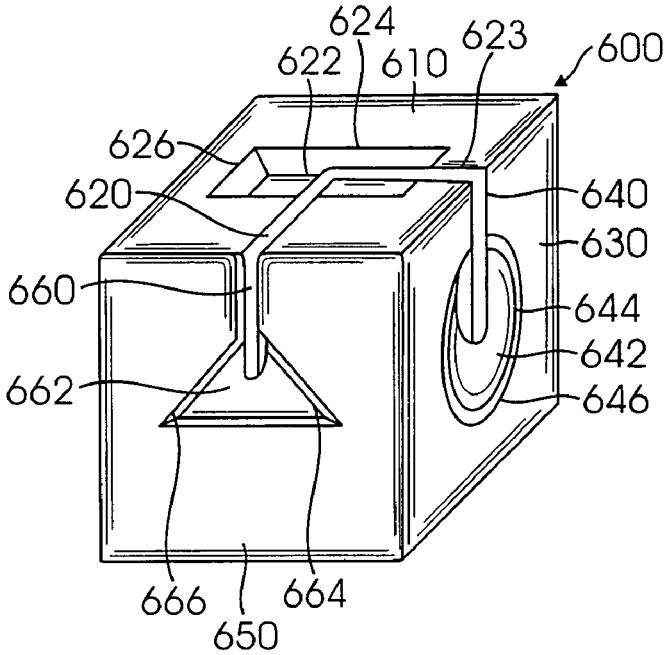
FIG. 15 is a perspective view of an alternative embodiment of a shape member having three different types of slots and rest spots on three different faces, each one illustrating the different numbers of rotation positions.

By way of example, FIG. 15 illustrates a shape member 600 having three different types of slots and rest spots on three different faces. Upper face 610 has an entrance slot 620 leading to a rest spot 622 which is generally rectangular in configuration and having a rectangular recessed face 624 and a rectangular recessed wall 626. The entrance slot 620 is connected and continues to entrance slots 623 and is connected to 640 on face 630 and from the other side it is connected to entrance slot 660, so all the entrance slots from 660, to 620, to 623, to 640 all are connected. One side face 630, the entrance slot 640 leads to rest spot 642 which is generally circular in configuration and has a circular recessed face 664 and circular recessed wall 646. One second side face 650, the entrance slot 660 leading to rest spot 662 is generally triangular in configuration and has a triangular recessed face 664 and triangular recessed wall 666, however the recess walls are not going all the way down to the cavities that terminated all those slots.

The shape member 600 has an interior chamber into which is inserted and retained any of the alternative interconnecting members 100, 200 or 300. It is demonstrated that the locking mechanism implemented by recess walls, can also serve to determine the numbers of rotation positions by which one member can be attached to another member at that rest point. There is a circular 646 that has infinite positions, equal side triangle 662 and a square 622. A shape member that will have a male triangle cap on its face will interconnect to face 650 with three different ways to attach. The same for a shape member that has a rectangular male cap on its face and will interconnect to face 610 with four possible ways. The symmetry of those rest point will the determine the numbers of possible positions. It also will be appreciated that the rest spots can also be of other configurations such as pentagonal, hexagonal, and octagonal. As a result, the combination of different shaped rest spots on the faces of the building blocks combined with different spring biased interconnecting means enables the three dimensional puzzle of the present invention to be created having an infinite number of shapes and orientations to create an infinite variety of puzzles.

Figure 16:
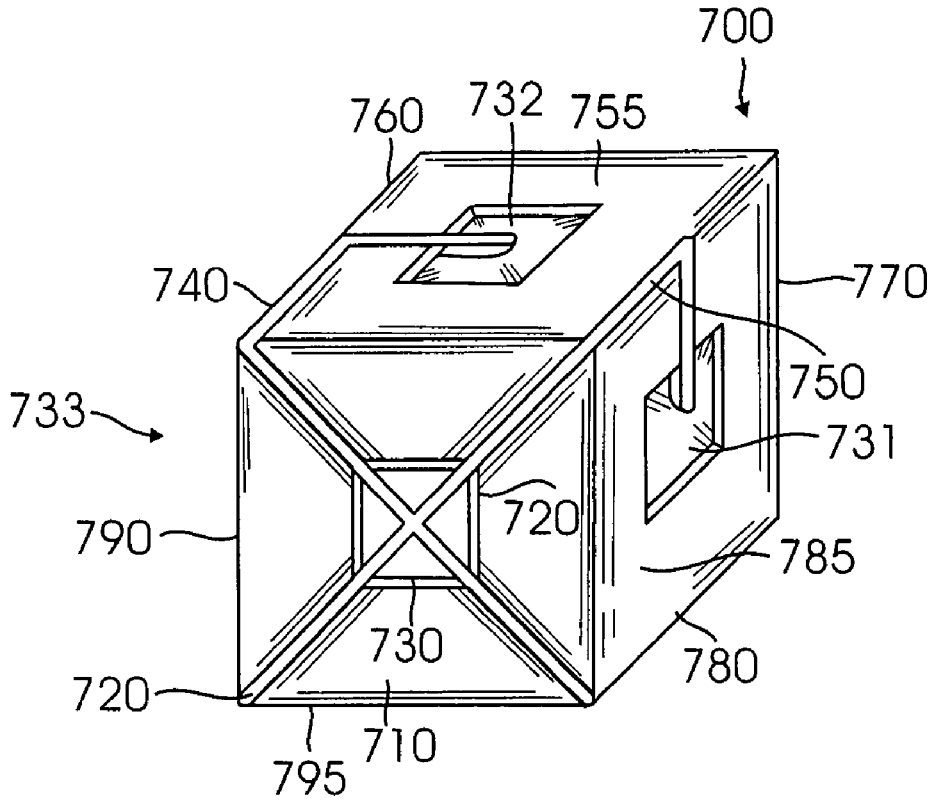
FIG. 16 is a perspective view an another alternative embodiment of a shape member illustrating different types of entrance and exists slots which can be incorporated into the present invention.

Another variation on the types of openings in a shape member face which can be used with the present invention is illustrated in the shape member 700 in FIG. 16. The face 710 has a diagonal mesh of slot 720 with a central rest spot 730 in the middle of face 710. The slots then extend into lengthwise slots 740, 750, 780 and terminate in the perpendicular slot portion on each face. This is to demonstrate that even though the five rest point are in the middle of each face 710, 785, 795, 755, 760 of the shape member, these are the same as the shape member in FIG. 6 through FIG. 8 so it can use a different mesh of opening slots to achieve the same rest points 730, 731, 732, 733, 734.

Figure 17:
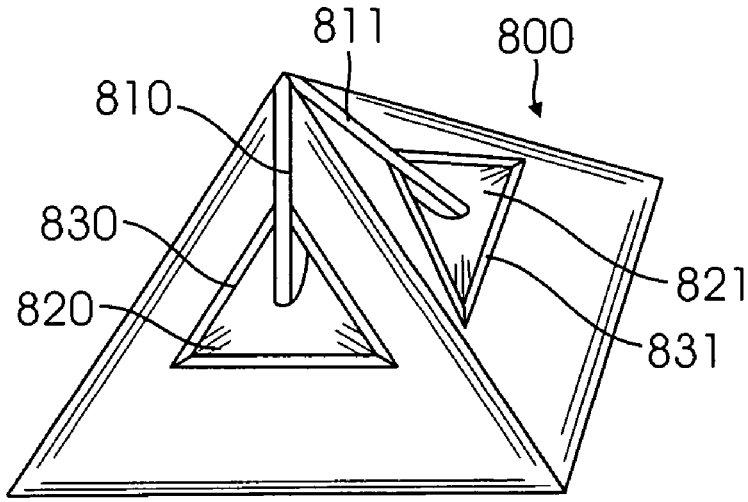
FIG. 17 is a perspective view of the shape member having an alternative shape which is a tetrahedron.

In addition to cube shape members, it is within the spirit and scope of the present invention to use other abstract shape members 800 as illustrated in FIG. 17 which is a tetrahedron.

By way of example, only, each face can have a slotted entrance 810, 811 leading to a triangular shaped rest spot 820, 831, having a triangular recessed face 830, 831, and triangular wall 840. It will further be appreciated that it is within the spirit and scope of the present invention to incorporate any of the slotted shapes and rests spots illustrated in FIGS. 8 and 9 into the tetrahedron shape member illustrated in FIG. 14.

Another alternative embodiment for a shape member 900 is illustrated in FIG. 15 where two cubic shape members can be made of two parts are joined by having mating pins (not shown) inserted into receiving openings 910 and the blocks 920 and 930 further held together by tongue 940 and groove 950 assemblies. Any of the entrance slots and recessed faces illustrated in FIGS. 1 through 14 can be incorporated into this double shape member structure.

Figure 19:
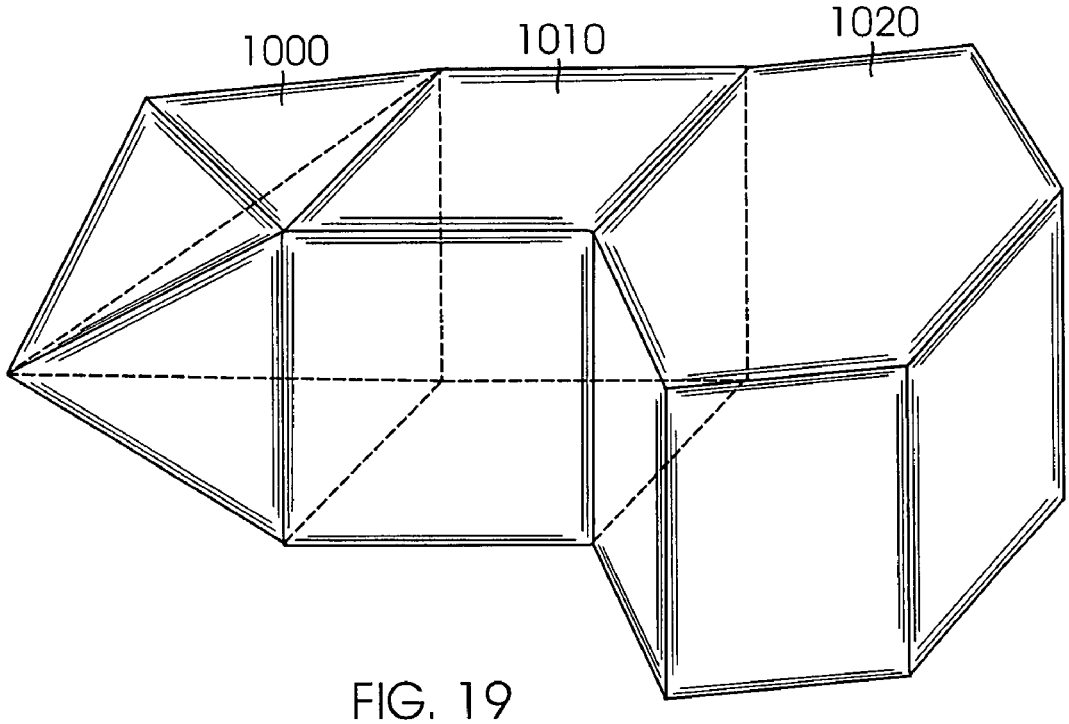
FIG. 19 is a perspective view illustrating a multiplicity of differently shaped members retained together by the present invention interconnecting means.

FIG. 19 illustrates that any multiplicity of different shapes of shape members can be utilized with the slot and rest spot designs and any of the three spring biased interconnecting means previously discussed. As illustrated in FIG. 19, a pentagonal shape member 1000 is connected to a cubic shape member 1010 which in turn is connected to a hexagonal shape member 1020.

Figure 20A:
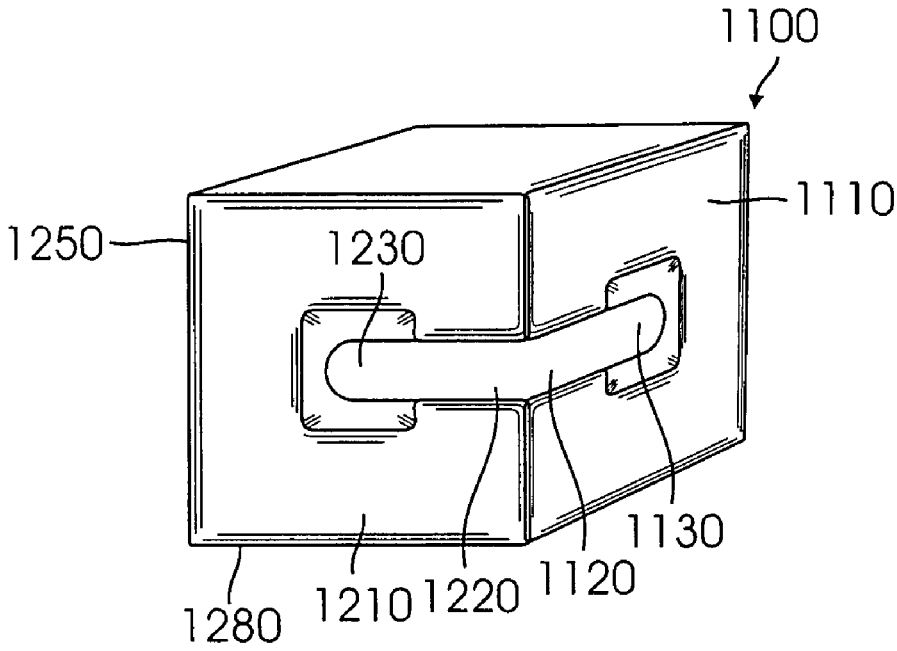
FIG. 20A is s a perspective view of shape members with an alternative slot arrangement on its faces that can serve as incoming and outgoing slots.
Figure 20B:
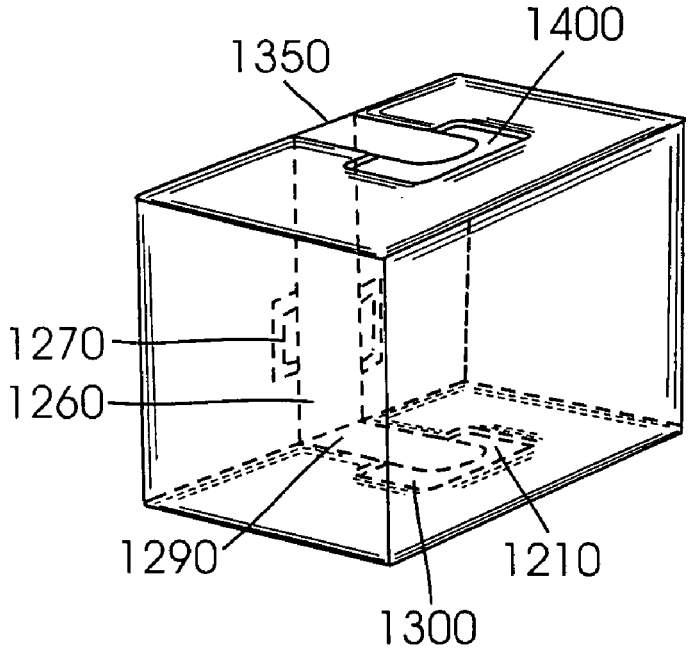
FIG. 20B is a perspective view of the same shape as in FIG. 20A, but illustrating the other side of the shape member.

FIGS. 20A and 20B illustrate an alternative configuration for an implementation of the mechanism 300. It has double slot arrangement in which shape member 1100 has one face 1110 with an entrance slot 1120 leading to a rest spot 1130 and perpendicular face 1210 has an entrance slot 1220 leading to a rest spot 1230 and the two entrance slots 1120 and 1220 are interconnected. Face 1250 has an exit slot 1260 leading to a rest spot 1270 and face 1280 has an exit slot 1290 leading to a rest spot 1300 and slot 1350 also leads to rest point 1400. Exit slots 1260 and 1290 can also be interconnected. One interconnection mechanism 300 that can serve for interconnecting other shape member as incoming opening and reside inside the cavity terminating the mesh of slots 1120 and can move from rest point 1130 to rest point 1230, and another interconnection mechanism 300 that can serve for interconnecting other shape member as outgoing opening and reside inside the cavity terminating the mesh of slots 1260 and can move between rest points 1270, 1300 and 1400.

Figure 21:
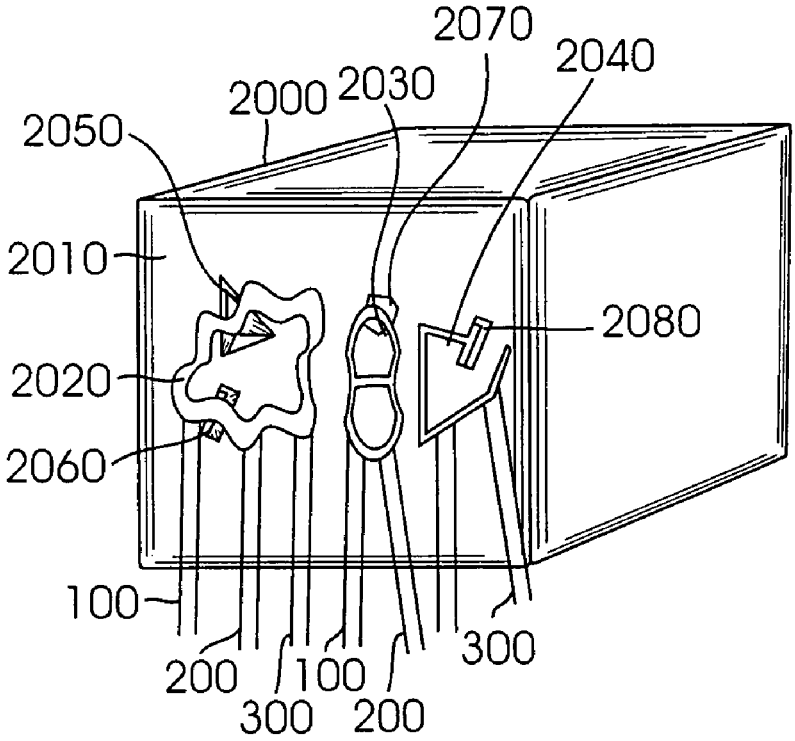
FIG. 21 is a perspective view of an alterative shape member used with the present invention, illustrating a multiplicity of different slot arrangements which can be incorporated in one or more faces of a shape member used with the present invention.

In another variation, each shape member 2000 can have a multiplicity of meshes of opening slots on each face. Referring to FIG. 21, a shape member 2000 is illustrated with a face 2010 having different sinusoidal slot such as 2020, 2030 and 2040 on the same face. One or more interconnecting means can be connected through each of those slots. On each of those slots there can be many rest points such as 2050, 2060, 2070, and 2080.

Figure 22:
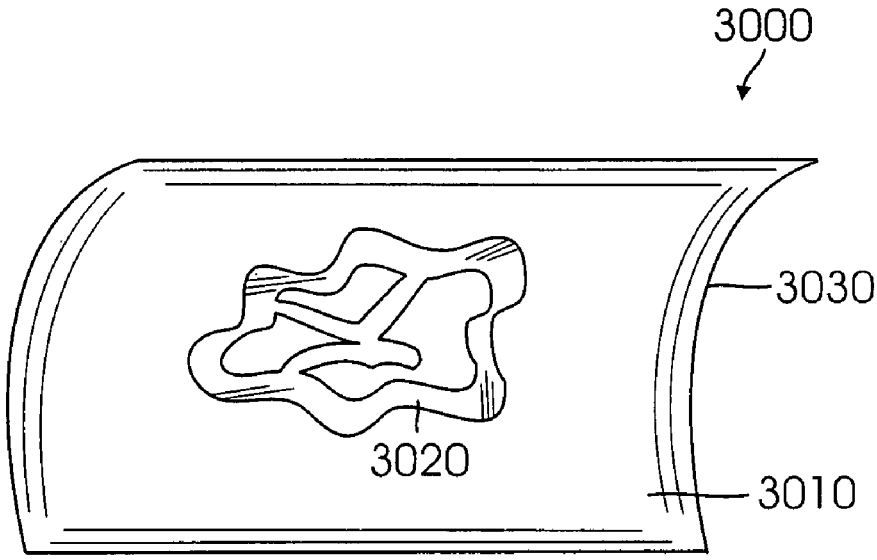
FIG. 22 is a perspective view of an alternative shape member which is an open shape that does not have all its surfaces and which is used the present invention.

In addition to having a closed shape member which has an interior chamber to accommodate at least one of the interconnecting means 100, 200 or 300 it is also within the spirit and scope of the present invention to have an open shape member 3000 as illustrated in FIG. 22. The shape member 3000 is a shell having an outer face 3010 with at least one slot 3020 and the interconnecting means 100, 200 or 300 is retained so that it protrudes from the back face and out the slot 3020 in the front face 3010. It will be appreciated that the shell shape member 3000 can be any shape and can have any one or more slots of any configuration extending through it.

Figure 23:
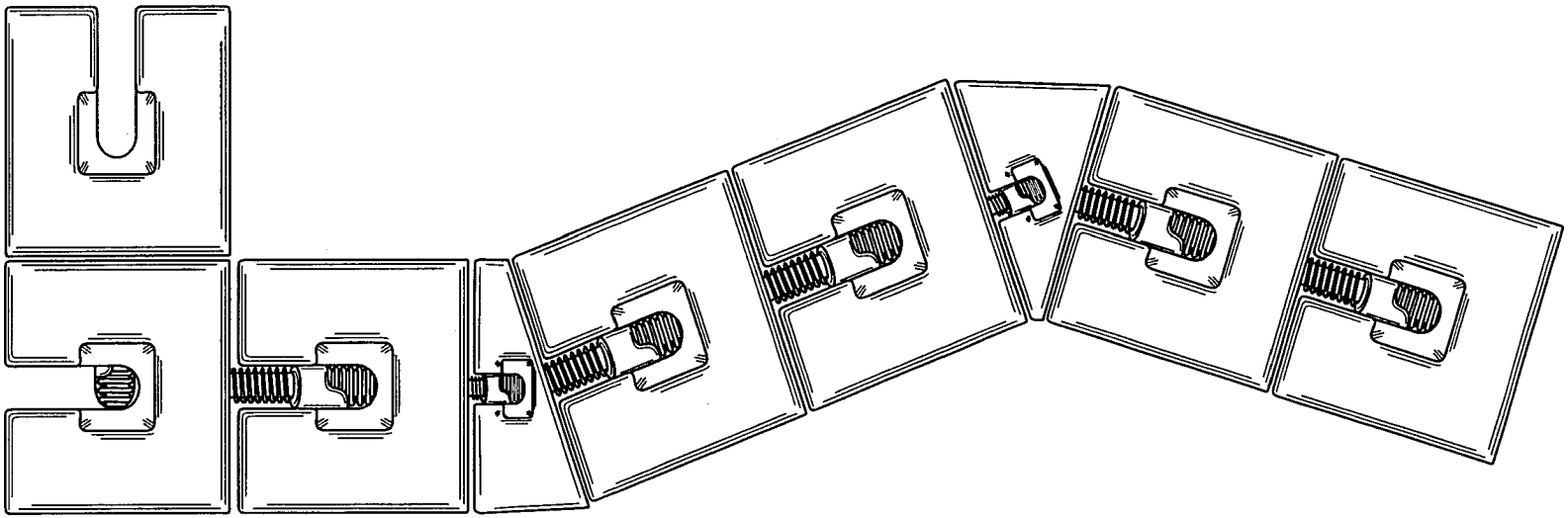
FIG. 23 is a perspective view of a combination of two different shape members incorporating the present invention interconnecting means.

It is also possible to take any shape combination of shape members or blocks and create a more sophisticated entangled design as illustrated in FIG. 23. Two different shape members can create interesting blocks as illustrated in FIGS. 9 and 10 can be extended and then a series or row of shapes can be wrapped around another series or row of shapes in any infinite variety of configurations.

Figure 24:
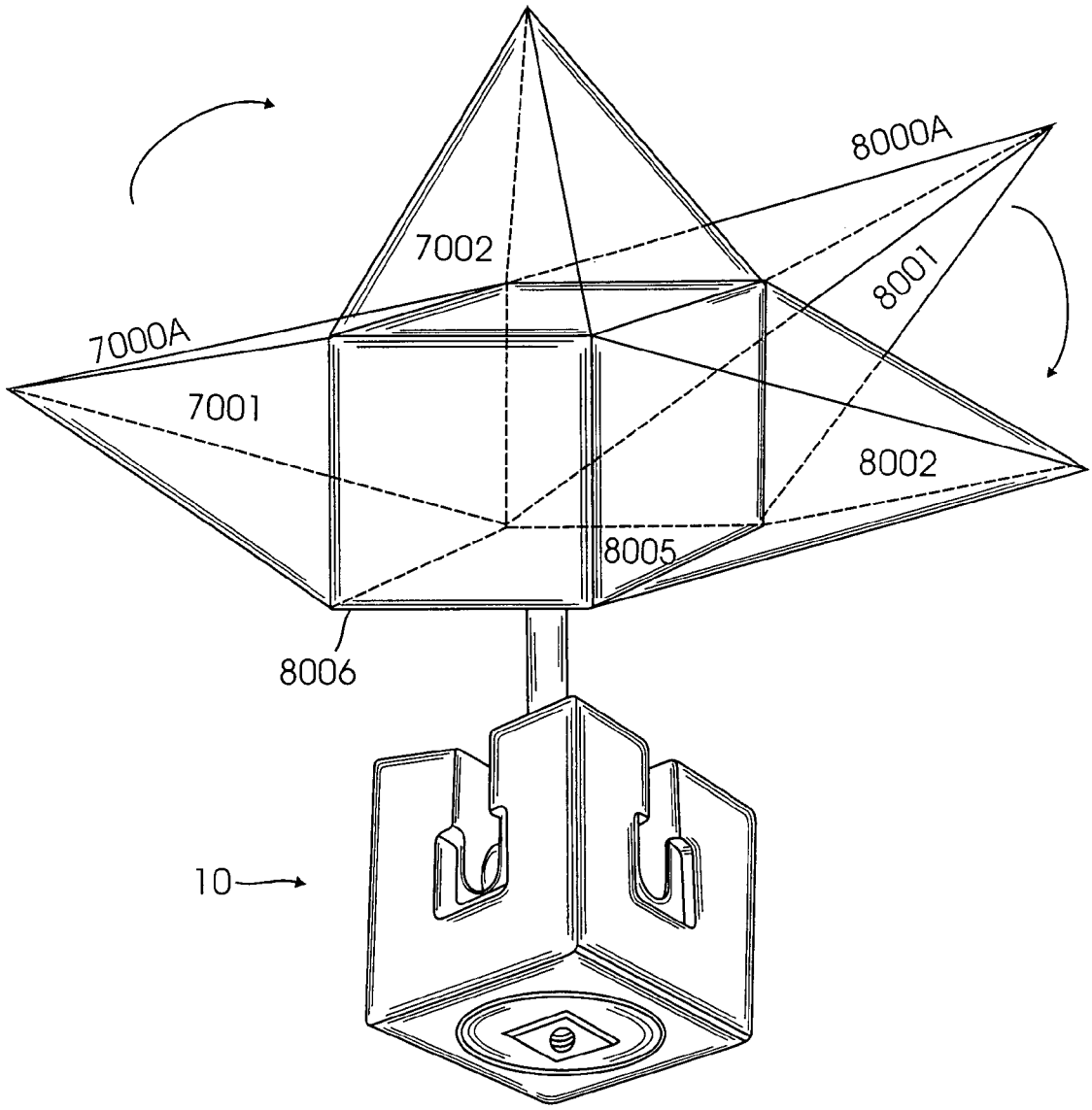
FIG. 24 is a perspective view of an alternative configuration of a two pyramid shape interconnected to one cube shape member and their possible movements.

Referring to FIG. 24, as illustrated shape members can be a cube with two square pyramids interconnecting to the cube with interconnection means 100, 200 or 300. Pyramid 7000A can move from position 7001 to 7002 on the faces of the cube 8006 and vice versa and pyramid 8000A can move from position 8001 to position 8002 on the faces of the cube 8006 and vice versa.

Those two pyramids than can interconnect other shape members and it create like a split point that one shape member (cube 8006 will split like into two branches of interconnecting members. Also the cube from side 8005 will interconnected to some other shape members, protruding from at least one and as illustrated in FIG. 21 three of the faces or another one of the infinite shapes of building blocks which can be used with the present invention.

Figure 25:
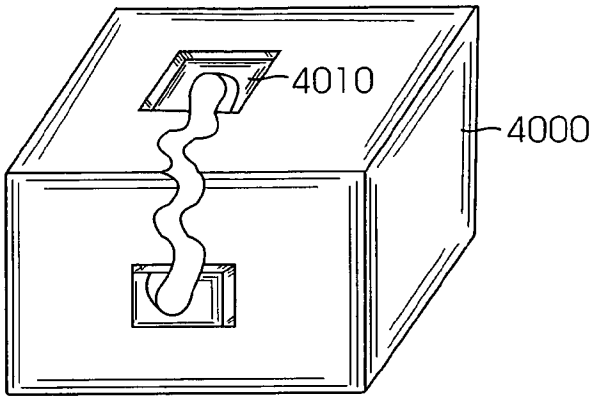
FIG. 25 is a perspective view of a shape member with an alternative configuration for an entrance or exit slot, illustrating that the slot can be sinusoidal or wavy and does not have to be straight.
Figure 26:
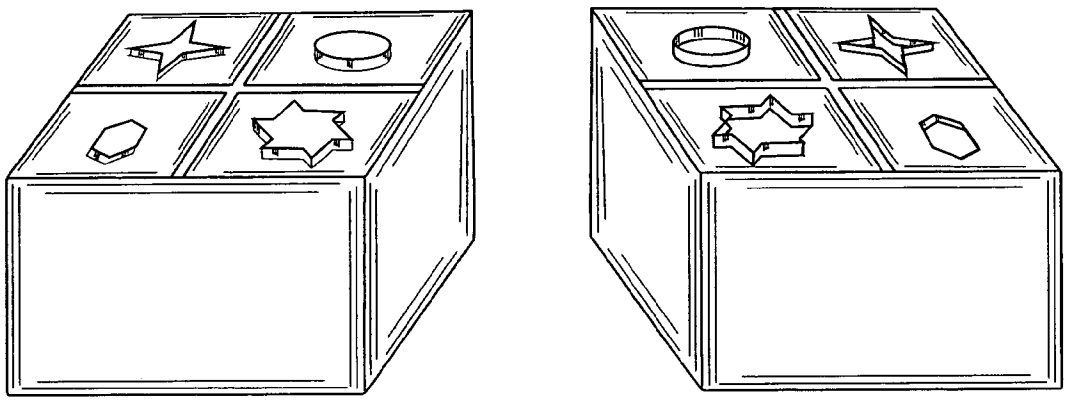
FIG. 26 is a perspective view illustrating alternative attaching means such as male pins and female openings to attach two shape members together which then can be movably attached to adjacent shape members through the present invention.

In addition, as illustrated in FIG. 25, the entrance slot 4010 in shape member 4000 does not have to be straight and can be wavy or undulating and can take any shape or configuration desired. While illustrated in two faces, it will be appreciated that the entrance slot can be on all or some faces and can be any desired shape.

Figure 18:
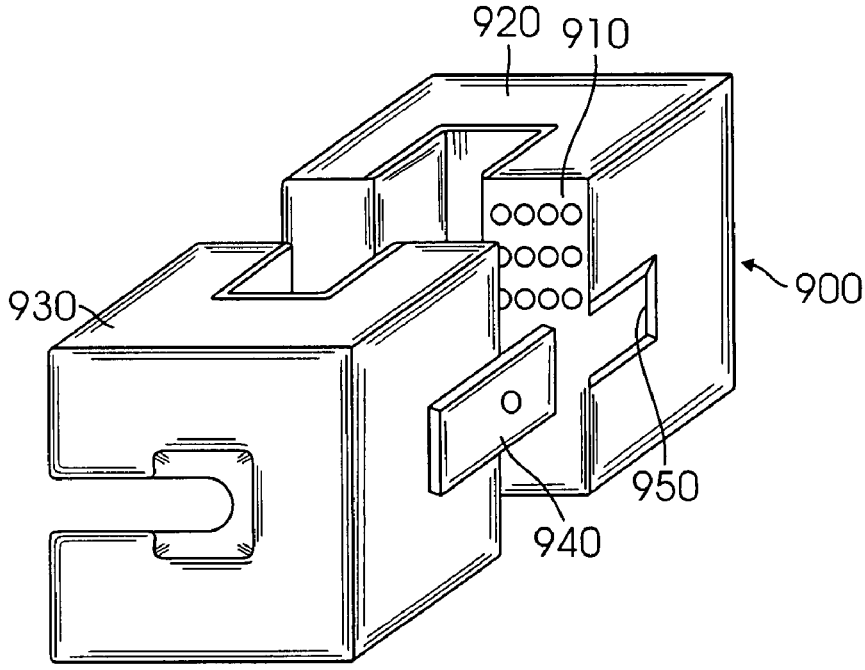
FIG. 18 is a perspective view of an alternative of two portion pieces of one alternative shape member alternative joining mechanism to join two building blocks together.

While one way to interlock shape members was illustrated in FIG. 18, it will be appreciated that any number of shape members can be interlocked in any way and used with the present invention. For example, as shown in FIG. 23, interlocking male pins and female openings can be used to lock two adjacent shape members together and then the shape members can be movably attached to other shape members blocks by any of the previous methods discussed.

Figure 27:
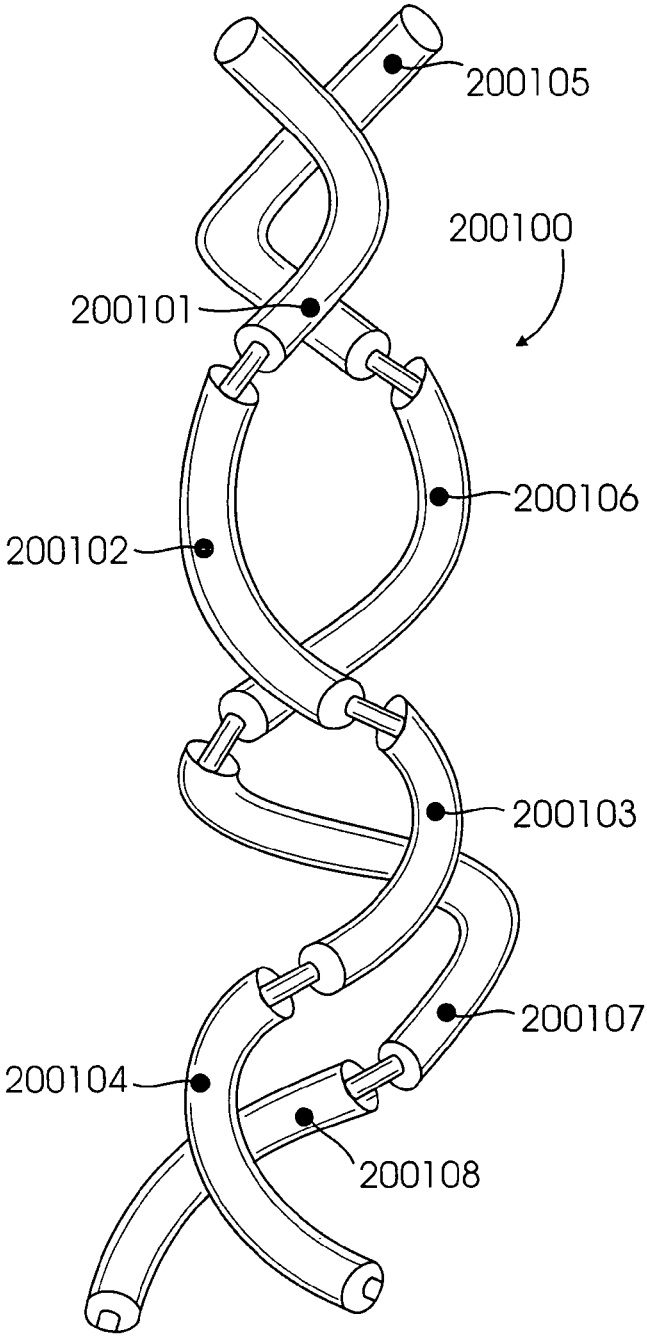
FIG. 27 is a perspective view illustrating entanglement of two toys, without any interconnecting means.
Figure 28:
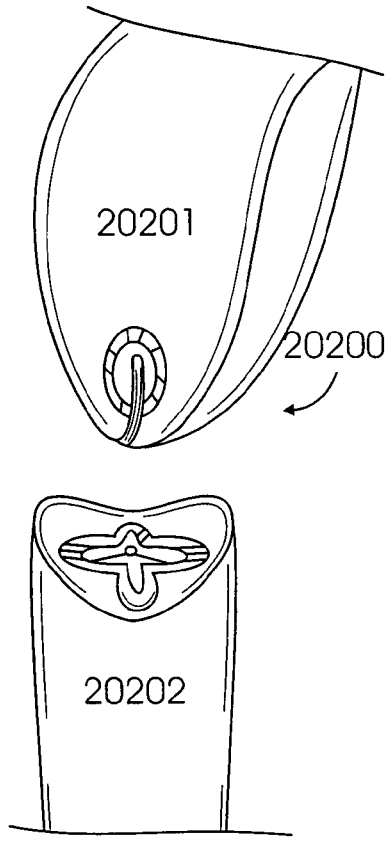
FIG. 28 is the exploded view of the connection between each of two members in each toy as described in FIG. 27.

FIG. 27 illustrates entanglements of two toys, one made of collection of right angle tubes 200101, 200102, 200103, 200104 and the second made of a collection of left angle tubes 200105, 200106, 200107, and 200108. Each toy had interconnection mechanism type 100, 200 and receiving slots as indicated in FIG. 28, the bottom curve shape 20201 going to interlock with 20202 rest point, and it has a slot to move to the other side 20200 so it has some freedom of movement of right and left. Therefore, each right angle tube can move in each toy.

The entanglements enable parts to be held tighter without any interconnecting mechanism between the toys.

Figure 29:
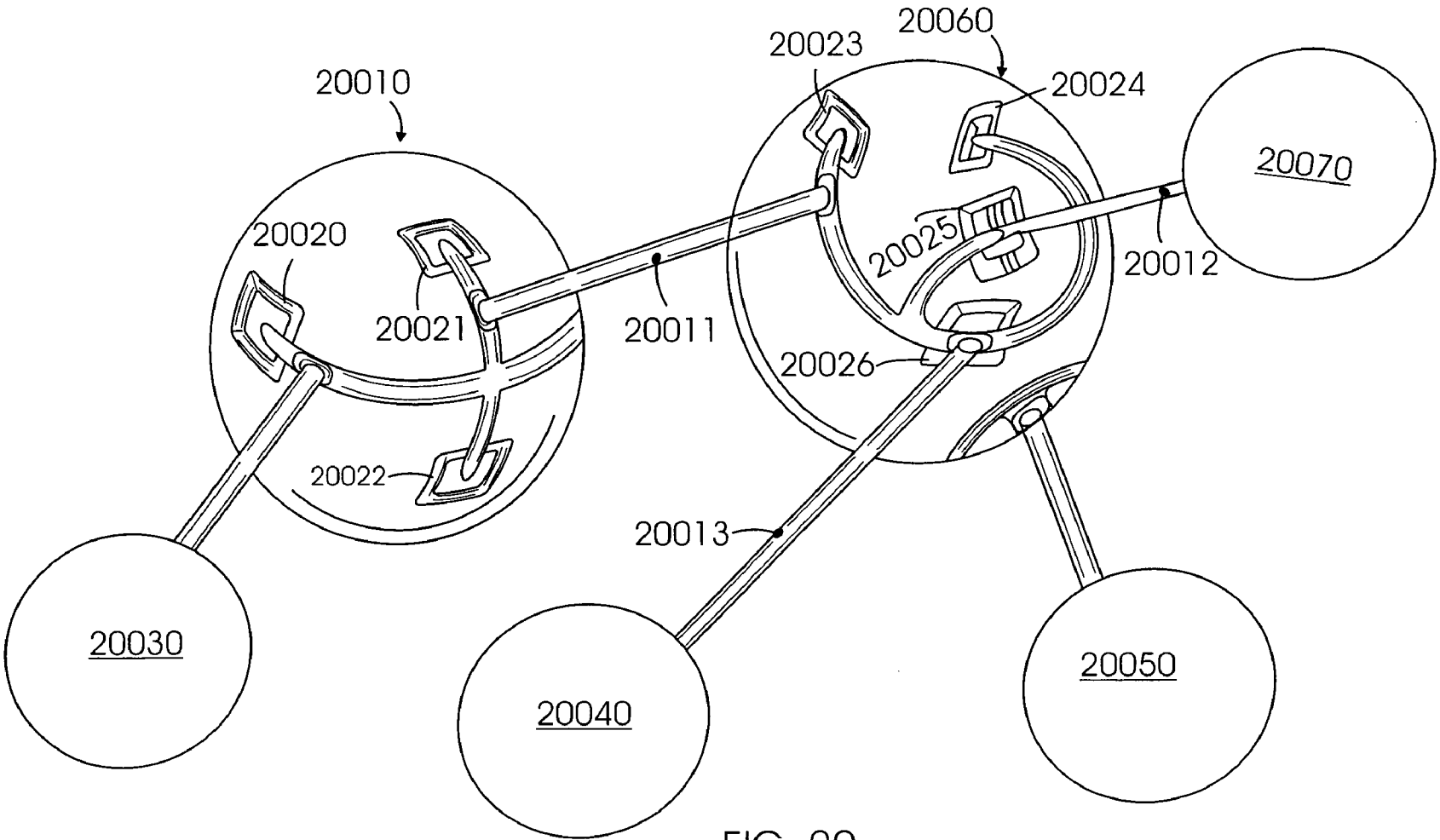
FIG. 29 is a perspective view illustrating six balls with different slots schemes and different interconnection means.

FIG. 29 illustrates that even round shape balls can be interconnected. Balls 20060, 20010, 20070, 20030, 20040, 20050 are all interconnected by mechanism 100, 200, and 300. Ball 20010 is interconnected to two balls 20030 and 20060. Ball 20060 interconnected at the same time to 20070, 20010, 20040, and 20050.

Ball 20010 has one mesh of slots that interconnection can move and several rest point 20021, 20020, and 20022. Ball 20060 has two set of meshes of slots. The one that connects with rest points 20023, 20024, 20025, 20026, and the other mesh is connected to 20050.

Figure 30:
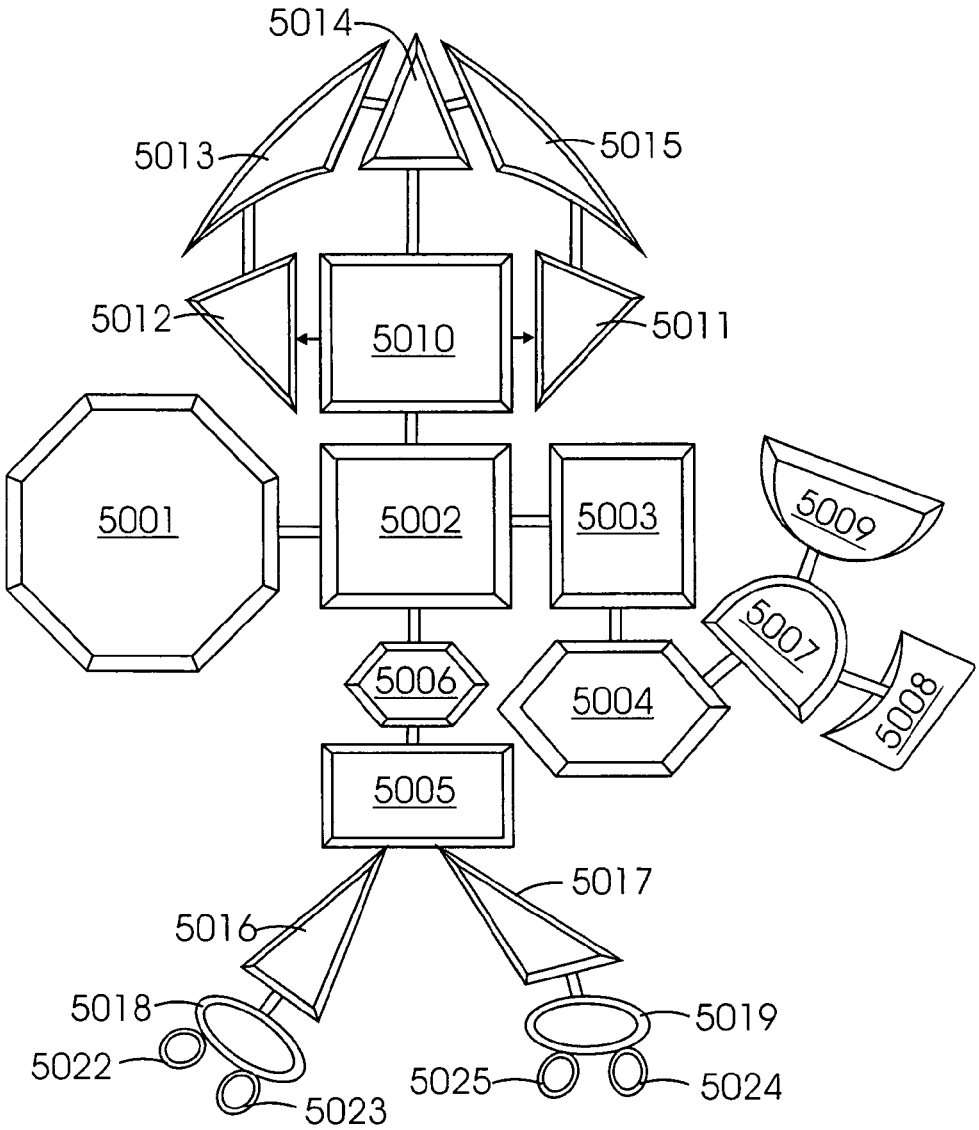
FIG. 30 is a top view of one toy which incorporates different types of members with different types of interconnection mechanisms.
Figure 31:
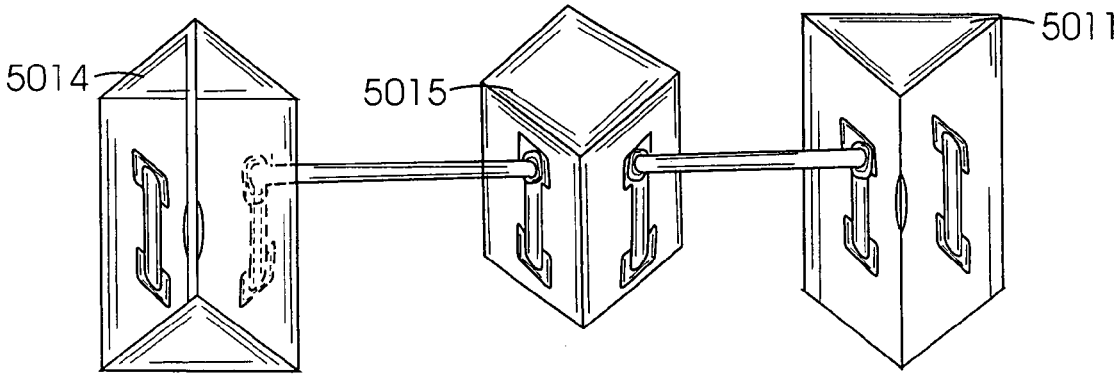
FIG. 31 is the exploded view of some three members from FIG. 30 showing how two shapes can interconnect.

FIG. 30 illustrates a top view of a toy that looks like a person, which comprises many different kinds of shapes, some with flat surfaces like 5002, 5001 and some with non flat surfaces like 5009, 5007, 5019. Each shape can interconnect to each other by any interconnecting means 00, 200 or 300.

In particular the exploded view on shapes 5014, 5015, 5011 where shape 5015 which is a prism is interconnected to two shapes 5014, 5011 at the same time and the available movement for this piece will be to lift 5015 up and down between two rest points. The two sides of the interconnecting mechanism will move with it on shapes 5014 and 5011. Of course shape 5014 continues to interconnect to shape 5010 and shape 5011 to 5010 as well.

Figure 32:
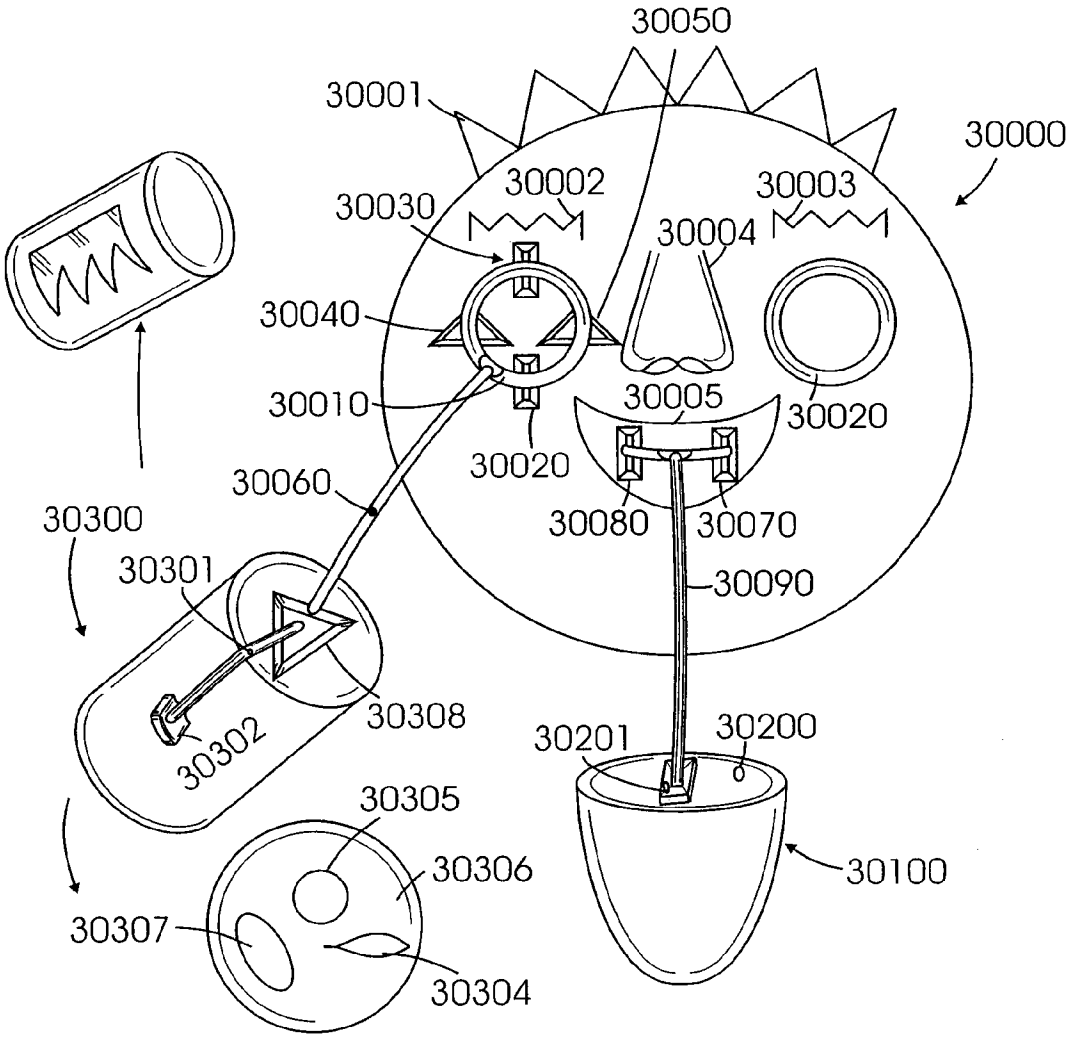
FIG. 32 is a view of a toy with it members and possible movements.

FIG. 32 illustrates a toy resembling a human being's face. Shape 30000 is a ball with some decoration 30001 such as hair, 30002, 30003 resembling eyebrows, 30004 resembling a nose and 30005 resembling the mouth. There are two moving shapes that are interconnected to the main shape 30000. One is the tongue 30100 with interconnection mechanism 30090 that can be 100, 200.

On the tongue surface 30200 there is female rectangular rest 30201 that will match the two males 30080 and 30070 on the mouth. The tongue can move from and rest from the right side of the tongue to left side of the tongue and also can be rotated in two position with one wide and one where the tongue is on the side.

The other shape that is interconnected is a cylinder 30300. On the first base of the 30300 there is a male triangle 30308 that will match the female rest area 30050 and 30040 on the main shape 30000 at the area of the eyes. (Of course the rest spots can also be on the second eye on 30020). Interconnection 30060 connects the cylinder 30300 to the main shape 30000 with interconnection mechanism 300. On the main face in the eye area the interconnection can move through the circular slot across the eye and can rest at four rest points 30040, 30050, 30030, 30020. Some are female 30040, 30050 and 30020, 30030 are male. 30050, 30040 have three rotational positions and 30020, 30030 has two rotational positions. The interconnection 30060 connected to male rest point 30308 and from there is a slot 30301 that connects to another female rest rectangular rest point on the surface of the round cylinder 30300. This rest area 30302 point will match the male 30020, 30030 rest areas.

There will be marking of eyelashes on the other side of the round cylinder 30300 opposite from area 30302. So if part 30300 will interconnect with 30302 on 30030, or 30020 it can have two possible orientations one with eyelashes up and other with eyelash down. On the other flat side of the cylinder 300300, the surface 300306 will have three different marking for the eyes ball 300305, 300304, 300307. So every time the cylinder will interconnect through 300302 and will rest on 30040 and 30050 rest points on the main shape 30000 it will have a place to rest on the right side of the eye or left side of the eye and it will also have three possible arrangements of the eyeballs.

This example demonstrates toys formed of different shapes are not necessarily flat. They can also include different mesh slots and more than on slot on each shape. In addition, each mesh can be a different shape and can have a different shape rest area such as triangular and rectangular and a mix of male and female locking mechanisms on the same slot and with a different number of rotation and orientation and provide a locking fit.

Therefore, it is within the spirit and scope of the present invention to incorporate any assembly of any combination of any shape members to form an extended multi three dimension shapes which are interconnected by one or more spring biased interconnecting means to form an infinite variety of the final multi-shaped toy which can be oriented to an infinite variety of shapes for pleasure and amusement. In particular interest will be assembly of a multiple of polyhedron shapes, all the same shapes in one chain. The scope is to move, shift and rotate all the members on the chain in order to create a larger symmetrical shape like if the shapes members are 27 cubes, than the challenge will be to form a 3×3×3 cube. In addition, if each side of the shape member cubes will be painted with a different color the challenge will be increase and will be to solve the puzzle not only to create the larger cube, but to create it to match a certain color pattern on the side of the final large cube.

Defined in detail, the present invention is a three dimensional puzzle or toy comprised of: (a) at lest two interconnecting abstract shape members in which each abstract shape member can be a different shape; (b) at least one surface on each abstract shape member; (c) each abstract shape member must be interconnected by at least one interconnection means to at least one other abstract shape member; (d) at least one of the abstract shape members being an "end shape member", having at least one opening entrance hole on its surface for the receiving at least one bolt of an interconnection mechanism means that is retained inside a cavity of an adjacent abstract shape member; (e) at least one of the shape members being a "start shape member" having at least one mesh of interconnected opening slots on its surface and with at least one cavity terminating in the end by a mesh of opening slots, wherein the bolts of the interconnection mechanism means that is retained inside one of the cavities can move throughout the mesh of interconnected opening slots, from one position on the mesh to another position on the mesh, and the end of the bolts of the interconnection mechanism means are attached by any permanent means to the adjacent abstract shape members, with at least one interconnection mechanism means which comprises a biasing spring, a retaining cup into which is fitted one end of a biasing spring, a bolt retained at one end by a bolt head or any stopper means and the opposite end of the bolt extending through an opening in the retaining cup so that the biasing spring surrounds a portion of the bolt and is positioned between the bolt head or any stopper means and the retaining cup, the end of the bolt which extends through the retaining cup extending out of the mesh of opening slots on the face of the abstract shape members and is retained permanently within the opening entrance hole of an adjacent abstract shape member, the bolt head or any stopper means portion of the bolt and retaining cup retained within interior cavities of the abstract shape members; (f) a pulling force on at least one of the abstract shape members overcoming the spring biasing forces and enabling the bolts to be moved into at least one position on the mesh of opening slots on the surface of adjacent abstract shape members and after the pulled abstract shape members are released, the biasing spring retains the adjacent abstract shape members in that fixed position; (g) at least one member of each toy must be an "end shape member" and another separate member must be "start shape member"; (h) each abstract shape member having at least one entrance hole on its surface like an "end shape member" or at least one mesh of opening slots, with at least one cavity terminating in the end by a mesh of opening slots, and with at least one interconnection mechanism like a "start shape member" or both; (i) the cup diameter being larger than the width of the slot; (j) the cup diameter being larger than the spring diameter; (k) the spring diameter being larger than the bolt diameter; (l) the bolt diameter being smaller than the width of the slots; (m) the bolt head or any stopper means diameter being larger than the spring diameter; and (n) the bolt head or any stopper means diameter being larger than the width of the slots. Two shape members or more can be interconnected to one other shape member. In addition, each toy can have more than one "end shape member" and more than one "start shape member". On each shape member including a "start shape member" and an "end shape member" there can be many entrance holes and there can be many sets of opening slots on its surface with many cavities, each terminating by the end of each opening slots, with many interconnection mechanisms as described above retained in each cavity.

Defined broadly, the present invention is a three dimensional puzzle or toy comprised of: (a) at least two abstract shape members, in which each abstract shape member can be a different shape; (b) at least one surface on each abstract shape member; (c) each abstract shape member must be interconnected by at least one interconnection means to at least one other abstract shape member; (d) at least one of the abstract shape members being an "end shape member" which has at least one opening entrance hole on its surface for the receiving at least one bolt of the interconnection mechanism means that is retained inside a cavity of an adjacent abstract shape member; (e) at least one of the abstract shape members being a "start shape member" having at least one mesh of interconnected opening slots on its surface and with at least one cavity terminating in the end by a mesh of opening slots, wherein the bolts of the interconnection mechanism means that is retained inside one of the cavities can move throughout the mesh of interconnected opening slots, from one position on the mesh to another position on the mesh, and the end of the bolts of the interconnection mechanism means are attached by any permanent means to the adjacent abstract shape members, with at least one interconnection mechanism means comprising a bolt, a spring biasing means affixed at one end to a bottom of the surface of a bolt head or any stopper means and an opposite end of the spring biasing means pressed against an interior surface of one of the cavities of the abstract shape members, an opposite end of the bolt extending out of the mesh of opening slots on the surface of the abstract shape member and is retained permanently within the opening entrance hole of an adjacent abstract shape member, the bolt head or any stopper means, biasing spring and portion of the bolt retained within the cavities of the abstract shape members; (f) a pulling force on at least one of the abstract shape members overcoming the spring biasing forces and enabling the bolts to be moved into at least one position on the mesh of opening slots on the surface of adjacent abstract shape members and after the pulled shape members are released, the biasing spring retains the adjacent shape members in that fixed positions; (g) at least one member of each toy must have an "end shape member" and a separate "start shape member"; (h) each abstract shape member having at least one entrance hole on its surface like an "end shape member" or at least one mesh of opening slots, with at least one cavity terminating in the end by a mesh of opening slots, and with at least one interconnection mechanism like a "start shape member" or both; (ii) the bolt diameter being smaller than the width of slots; and (j) the bolt head or any stopper means diameter being larger than the width of the slots. Two shape members or more can be interconnected to one other shape member. In addition, each toy can have more than one "end shape member" and more than one "start shape member". On each shape member including a "start shape member" and an "end shape member" there can be many entrance holes and there can be many sets of opening slots on its surface with many cavities, each terminating by the end of each opening slots, with many interconnection mechanisms as described above retained in each cavity.

Defined more broadly, the present invention is a three dimensional puzzle or toy comprising: (a) at least two abstract shape members, in which each abstract shape member can be a different shape; (b) at least one surface on each abstract shape member; (c) each abstract shape member must be interconnected by at least one interconnection means to at least one other abstract shape member; (d) at least one mesh of interconnected opening slots on the surface of each abstract shape member with at least one cavity terminating in the end of the mesh of the opening slots and with at least one interconnection mechanism means retained in one of the abstract shape member cavities which consist of a retaining cup into which is fitted one end of a biasing spring, a bolt retained at one end by the first bolt head or any stopper means the opposite end of the bolt extending through an opening in the retaining cup so that the biasing spring surrounds a portion of the bolt and is positioned between the bolt head or any stopper means and the retaining cup, the end of the bolt which extends through the retaining cup extending out of the mesh of opening slots on the face of abstract shape members and extends into the opening in the adjacent abstract shape members and is incorporated as part of the interconnecting means of the adjacent shape members as well, which includes a retaining cup into which is fitted one end of a biasing spring, the bolt retained at one end by a stop plate or a lock nut or any other stopper means on the other side and on the opposite end of the bolt extending through an opening in the retaining cup so that the biasing spring surrounds a portion of the bolt and is positioned between the stop plate or any other second stopper means and the retaining cup, with the same bolt incorporated into both interconnecting means; (e) a pulling force on at least one of the shape members overcoming one or both of the spring biasing forces and enabling the bolts to be moved into at least one position on the mesh of opening slots on the surface of the adjacent shape members, and the bolts can move within the same shape members that have been pulled between its mesh of opening slots as well as to a new position and after the pulled shape members are released, the biasing spring retains the adjacent shape members in that fixed position; (f) the cup diameter being larger than the width of the slots; (g) the cup diameter being larger than the spring diameter; (h) the spring diameter being larger than the bolt diameter; (i) the bolt diameter being smaller than the width of the slots; and (j) the bolt head or any stopper means diameter being larger than the width of the slots. Two shape members or more can be interconnected to one other shape member. In addition, each toy can have more than one "end shape member" and more than one "start shape member". On each shape member including a "start shape member" and an "end shape member" there can be many entrance holes and there can be many sets of opening slots on its surface with many cavities, each terminating by the end of each opening slots, with many interconnection mechanisms as described above retained in each cavity.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A three dimensional puzzle or toy comprised of:

a. at least two interconnecting abstract shape members in which each abstract shape member can be a different shape;

b. at least one surface on each abstract shape member;

c. each abstract shape member must be interconnected by at least one interconnection means to at least one other abstract shape member;

d. at least one of the abstract shape members being an end shape member, having at least one opening entrance hole on its surface for the receiving of at least one bolt of an interconnection mechanism means that is retained inside a cavity of an adjacent abstract shape member;

e. at least one of the shape members being a start shape member having at least one mesh of interconnected opening slots on its surface and with at least one cavity terminating in the end by a mesh of opening slots, wherein the at least one bolt of the interconnection mechanism means that is retained inside one of the cavities can move throughout the mesh of interconnected opening slots, from one position on the mesh to another position on the mesh, and the end of the at least one bolt of the interconnection mechanism means are attached by any permanent means to the adjacent abstract shape members, with at least one interconnection mechanism means which comprises a biasing spring, a retaining cup into which is fitted one end of a biasing spring, a bolt retained at one end by a bolt head or any stopper means and the opposite end of the bolt extending through an opening in the retaining cup so that the biasing spring surrounds a portion of the bolt and is positioned between the bolt head or any stopper means and the retaining cup, the end of the bolt which extends through the retaining cup extending out of the mesh of opening slots on the face of the abstract shape members and is retained permanently within the opening entrance hole of an adjacent abstract shape member, the bolt head or any stopper means portion of the bolt and retaining cup retained within interior cavities of the abstract shape members;

f. wherein a pulling force on at least one of the abstract shape members overcomes the spring biasing forces and enables the bolts to be moved into at least one position on the mesh of opening slots on the surface of adjacent abstract shape members and after the pulled abstract shape members are released, the biasing spring retains the adjacent abstract shape members in that fixed position;

g. each abstract shape member having at least one entrance hole on its surface at least one mesh of opening slots, with at least one interconnection mechanism or both;

h. the cup diameter being larger than the width of the opening slots;

i. the cup diameter being larger than the spring diameter;

j. the spring diameter being larger than the bolt diameter;

k. the bolt diameter being smaller than the width of the slots;

l. the bolt head or any stopper means diameter being larger than the spring diameter; and m. the bolt head or any stopper means diameter being larger than the width of the slots.

2. A three dimensional puzzle or toy comprised of:

a. at least two abstract shape members, in which each abstract shape member can be a different shape;

b. at least one surface on each abstract shape member;

c. each abstract shape member must be interconnected by at least one interconnection means to at least one other abstract shape member;

d. at least one of the abstract shape members being an end shape member which has at least one opening entrance hole on its surface for the receiving of at least one bolt of the interconnection mechanism means that is retained inside a cavity of an adjacent abstract shape member;

e. at least one of the abstract shape members being a start shape member having at least one mesh of interconnected opening slots on its surface and with at least one cavity terminating in the end by a mesh of opening slots, wherein the at least one bolt of the interconnection mechanism means that is retained inside one of the cavities can move throughout the mesh of interconnected opening slots, from one position on the mesh to another position on the mesh, and the end of the bolts of the interconnection mechanism means are attached by any permanent means to the adjacent abstract shape members, with at least one interconnection mechanism means comprising a bolt, a spring biasing means affixed at one end to a bottom of the surface of a bolt head or any stopper means and an opposite end of the spring biasing means pressed against an interior surface of one of the cavities of the abstract shape members, an opposite end of the bolt extending out of the mesh of opening slots on the surface of the abstract shape member and is retained permanently within the opening entrance hole of an adjacent abstract shape member, the bolt head or any stopper means, biasing spring and portion of the bolt retained within the cavities of the abstract shape members;

f. wherein a pulling force on at least one of the abstract shape members overcomes the spring biasing forces and enables the bolts to be moved into at least one position on the mesh of opening slots on the surface of adjacent abstract shape members and after the pulled shape members are released, the biasing spring retains the adjacent shape members in that fixed position;

g. each abstract shape member having at least one entrance hole on its surface or at least one mesh of opening slots, with at least one interconnection mechanism or both;

h. the bolt diameter being smaller than the width of the opening slots; and i. the bolt head or any stopper means diameter being larger than the width of the slots.

3. A three dimensional puzzle or toy comprising:

a. at least two abstract shape members, in which each abstract shape member can be a different shape;

b. at least one surface on each abstract shape member;

c. each abstract shape member must be interconnected by at least one interconnection means to at least one other abstract shape member;

d. at least one mesh of interconnected opening slots on the surface of each abstract shape member with at least one cavity terminating in the end of the mesh of the opening slots and with at least one interconnection mechanism means retained in one of the abstract shape member cavities which consist of a retaining cup into which is fitted one end of a biasing spring, a bolt retained at one end by the bolt head or any stopper means and the opposite end of the bolt extending through an opening in the retaining cup so that the biasing spring surrounds a portion of the bolt and is positioned between the bolt head or any stopper means and the retaining cup, the end of the bolt which extends through the retaining cup extending out of the mesh of opening slots on the face of abstract shape members and extends into the opening in the adjacent abstract shape members and is incorporated as part of the interconnecting means of the adjacent shape members as well, which includes a retaining cup into which is fitted one end of a biasing spring, the bolt retained at one end by a stop plate or a lock nut or any other stopper means and on the opposite end of the bolt extending through an opening in the retaining cup so that the biasing spring surrounds a portion of the bolt and is positioned between the stop plate or any other second stopper means and the retaining cup, with the same bolt incorporated into both interconnecting means;

e. wherein a pulling force on at least one of the shape members overcomes one or both of the spring biasing forces and enables the bolts to be moved into at least one position on the mesh of opening slots on the surface of the adjacent shape members, and the bolts can move within the same shape members that have been pulled between its mesh of opening slots as well as to a new position and after the pulled shape members are released, the biasing spring retains the adjacent shape members in that fixed position;

f. the cup diameter being larger than the width of the slots;

g. the cup diameter being larger than the spring diameter;

h. the spring diameter being larger than the bolt diameter;

i. the bolt diameter being smaller than the width of the slots; and j. the bolt head or any stopper means diameter being larger than the width of the slots.

* * * * *